US012384650B2

(12) United States Patent
Kurtz et al.

(10) Patent No.: US 12,384,650 B2
(45) Date of Patent: Aug. 12, 2025

(54) AUTOMATED CREEL ASSEMBLIES AND SYSTEMS AND METHODS OF MAKING AND USING SAME

(71) Applicant: COLUMBIA INSURANCE COMPANY, Omaha, NE (US)

(72) Inventors: Kallin Kurtz, Apison, TN (US); Rocky Tillman, Rocky Face, GA (US); Wes Moore, Rock Spring, GA (US); Zachary Hall, Dalton, GA (US)

(73) Assignee: Columbia Insurance Company, Omaha, NE (US)

( * ) Notice: Subject to any disclaimer, the term of this patent is extended or adjusted under 35 U.S.C. 154(b) by 213 days.

(21) Appl. No.: 18/349,538

(22) Filed: Jul. 10, 2023

(65) Prior Publication Data

US 2024/0140756 A1 May 2, 2024

Related U.S. Application Data

(63) Continuation of application No. 16/526,595, filed on Jul. 30, 2019, now Pat. No. 11,738,966.

(60) Provisional application No. 62/711,886, filed on Jul. 30, 2018.

(51) Int. Cl.

| | |
|---|---|
| ***B65H 67/06*** | (2006.01) |
| ***B65H 49/16*** | (2006.01) |
| ***B65H 67/02*** | (2006.01) |
| ***D02H 1/00*** | (2006.01) |
| *B65H 67/08* | (2006.01) |

(52) U.S. Cl.

CPC ..... *B65H 67/065* (2013.01); *B65H 49/16* (2013.01); *B65H 67/02* (2013.01); *B65H 67/063* (2013.01); *B65H 67/067* (2013.01); *D02H 1/00* (2013.01); *B65H 67/086* (2013.01); *B65H 2701/31* (2013.01)

(58) Field of Classification Search

CPC .. B65H 67/065; B65H 67/067; B65H 67/063; B65H 67/082; B65H 67/086

See application file for complete search history.

(56) References Cited

U.S. PATENT DOCUMENTS

| | | | | |
|---|---|---|---|---|
| 5,495,990 A * | 3/1996 | Tamura | B65H 54/34 242/475.7 |
| 6,260,783 B1 * | 7/2001 | Realff | B65H 67/063 294/98.1 |
| 2014/0196264 A1 * | 7/2014 | Boetsch | D02G 1/125 28/248 |

(Continued)

*Primary Examiner* — Anna M Momper
*Assistant Examiner* — Ermia E. Melika
(74) *Attorney, Agent, or Firm* — Ballard Spahr LLP

(57) ABSTRACT

A creel assembly having an outer wall defines an interior space, a plurality of yarn package engagement locations distributed within the interior space, a gantry that is movable secured within the interior space, and at least one processor. The gantry is positioned to selectively engage yarn packages within the interior space. In use, the gantry can selectively access the plurality of yarn package engagement locations. The processor is communicatively coupled to the gantry and receives an input corresponding to a selected action by the gantry. Modular creel systems can be formed from a plurality of the disclosed creel assemblies. Methods of using and assembling the disclosed creel assemblies and modular creel systems are also disclosed.

20 Claims, 28 Drawing Sheets

(56) References Cited

U.S. PATENT DOCUMENTS

| | | | | |
|---|---|---|---|---|
| 2014/0214234 | A1* | 7/2014 | Worsley | G05B 19/4189 701/2 |
| 2015/0354949 | A1* | 12/2015 | Lecky | G06Q 10/087 702/150 |
| 2018/0011491 | A1* | 1/2018 | Morton | B25J 9/1679 |

* cited by examiner

AUTOMATED CREEL ASSEMBLIES AND SYSTEMS AND METHODS OF MAKING AND USING SAME

CROSS-REFERENCE TO RELATED APPLICATIONS

This application is a continuation of U.S. Provisional patent application Ser. No. 16/526,595, filed Jul. 30, 2019, which claims the benefit of the filing date of U.S. Provisional Patent Application No. 62/711,886, filed Jul. 30, 2018, each of which is hereby incorporated by reference herein in its entirety for all purposes.

FIELD

This invention relates to an automated creel assembly and to the use of a plurality of such automated creel assemblies to produce a modular creel system.

BACKGROUND

In tufting/creeling operations, there is a need for improving safety and decreasing process time, changeover time, labor, and creel variability. The disclosed assemblies, systems, and methods can address one or more of these needs.

SUMMARY

Disclosed herein is a creel loading apparatus. The creel loading apparatus can comprise a frame and a platform that is movable along the frame on a first axis and a second axis that is perpendicular to the first axis. A rotary actuator can be configured to rotate at least a portion of the platform about the first axis. A gripper can be movably attached to the at least a portion of the platform that is configured to rotate about the first axis. The gripper can be configured to releasably engage an inner surface of a yarn package. A linear actuator can be configured to move the gripper along a linear actuator axis that is perpendicular to the first axis. The linear actuator can comprise a first stage and a second stage.

The creel loading apparatus can comprise a frame and a platform that is movable along the frame on a first axis and a second axis that is perpendicular to the first axis. A rotary actuator can be configured to rotate at least a portion of the platform about the first axis. A gripper can be movably attached to the at least a portion of the platform that is configured to rotate about the first axis. At least one camera can be attached to the platform. The at least one camera can be configured to detect a diameter of a measured yarn package corresponding to a remaining quantity of material on the measured yarn package. At least one processor can be is configured to receive an image of the measured yarn package from the at least one camera, and approximate the remaining quantity of material on the measured yarn package based on the image of the measured yarn package.

A system can comprise a creel loading apparatus, a staging area, and a robotic arm comprising a robotic arm gripper at a distal end of the robotic arm. The robotic arm and creel loading apparatus can be positioned with respect to the staging area so that the robotic arm can deliver yarn packages to the staging area, and the gripper of the creel loading apparatus can receive the yarn packages from the staging area.

The system can further comprise a creel, wherein the creel comprises the staging area.

A system can comprising a service robot having: a base, a gripper assembly having at least one gripper configured to releasably engage an inner surface of a yarn package, a service arm assembly having a proximal end secured to the base and a distal end secured to the gripper assembly, and an actuator configured to selectively move the service arm assembly to articulate the gripper assembly with respect to the base. The service robot can comprise a three-dimensional camera that is configured to determine a quantity of yarn packages on a yarn case. At least one processor can be communicatively coupled to the three-dimensional camera and the actuator of the service robot. The at least one processor can be configured to receive an input from the three-dimensional camera indicative of the quantity of yarn packages on the yarn case. The at least one processor can further be configured to selectively effect movement of the actuator.

A method can comprise receiving a first yarn package at a first position on a creel, storing a value in memory indicating that the first position on the creel is occupied, upon receiving an instruction to place a second yarn package at the first position on the creel, determining, based on the value in the memory, that the first position on the creel is occupied, and providing feedback to an operator indicating that the first position on the creel is occupied.

A system can comprise a creel defining a plurality of yarn package positions; a gantry configured to receive yarn packages at a loading location and place the yarn packages at select positions on the creel; a service robot configured to deliver packages to the gantry; a memory coupled with the one or more processors. The memory can have thereon a plurality of instructions to implement a method comprising: receiving a creel map comprising a plurality of yarn package engagement locations on the creel and identifiers for a yarn case to be received at each respective yarn case staging location, based on the creel map, causing the service robot to deliver select yarn packages from respective yarn cases to the gantry, and based on the creel map, causing the gantry to deliver the select yarn packages to respective yarn package engagement locations.

DESCRIPTION OF THE DRAWINGS

The accompanying drawings, which are incorporated in and constitute a part of this specification, illustrate certain aspects of the instant invention and together with the description, serve to explain, without limitation, the principles of the invention. Like reference characters used therein indicate like parts throughout the several drawings.

DETAILED DESCRIPTION

Figure 1:
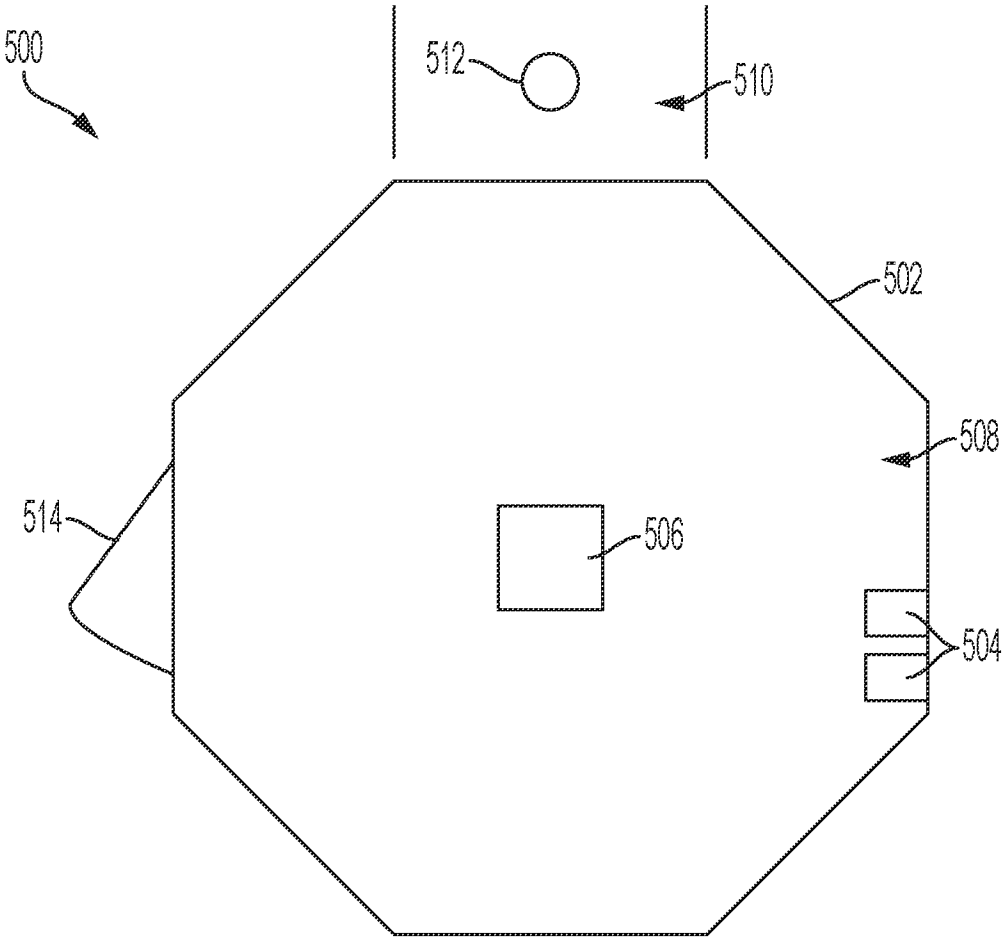
FIG. 1 is a schematic top view of any exemplary creel assembly as disclosed herein.
Figure 2:
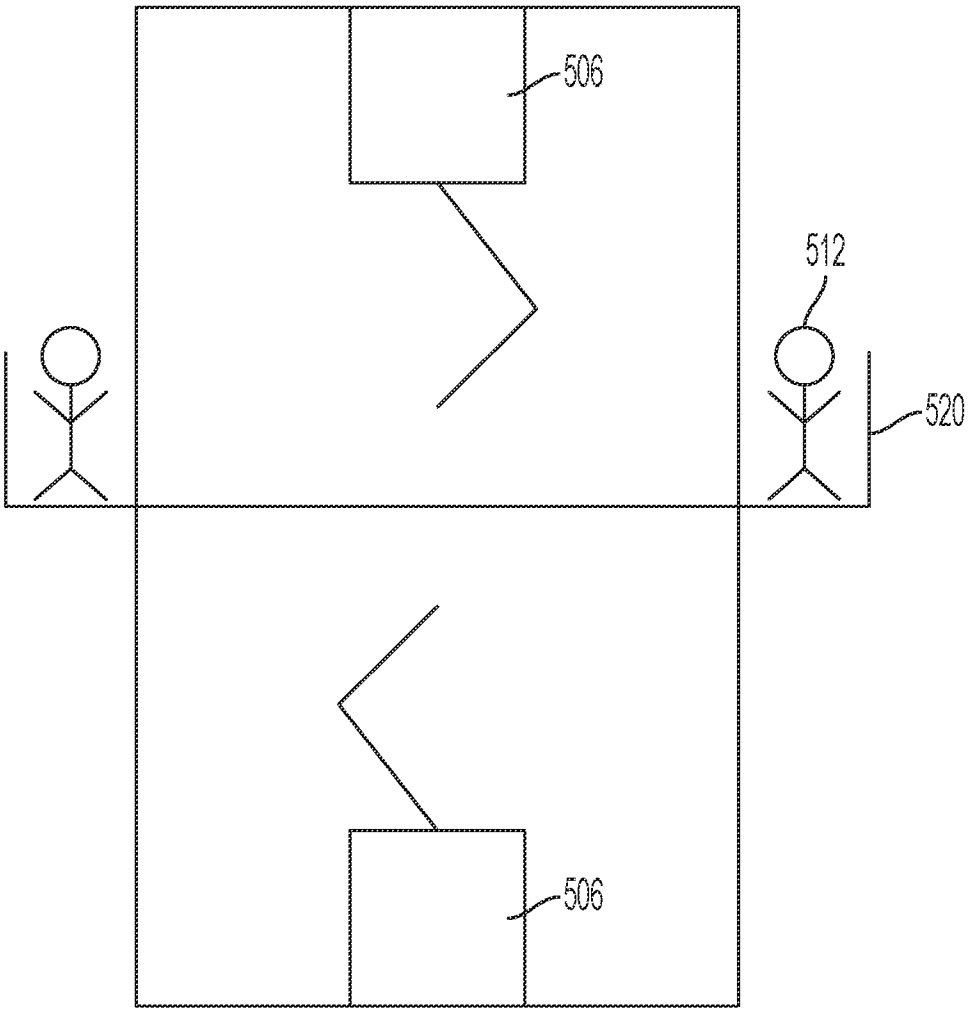
FIG. 2 is a schematic side view of a multi-level creel system with vertically stacked creel assemblies as disclosed herein.
Figure 3:
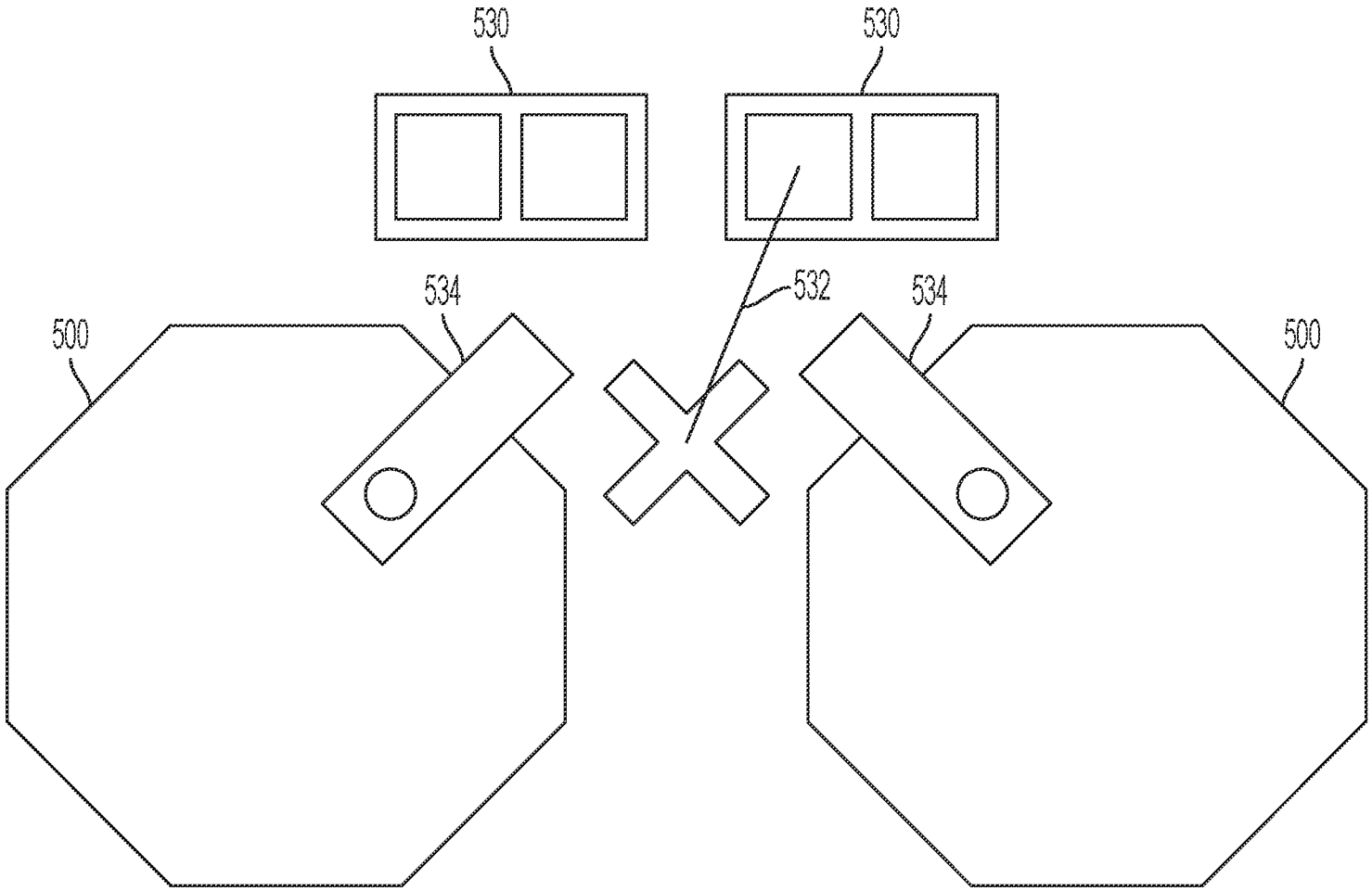
FIG. 3 is a schematic top view of an exemplary feeder assembly for delivering yarn packages to a creel assembly as disclosed herein.
Figure 4:
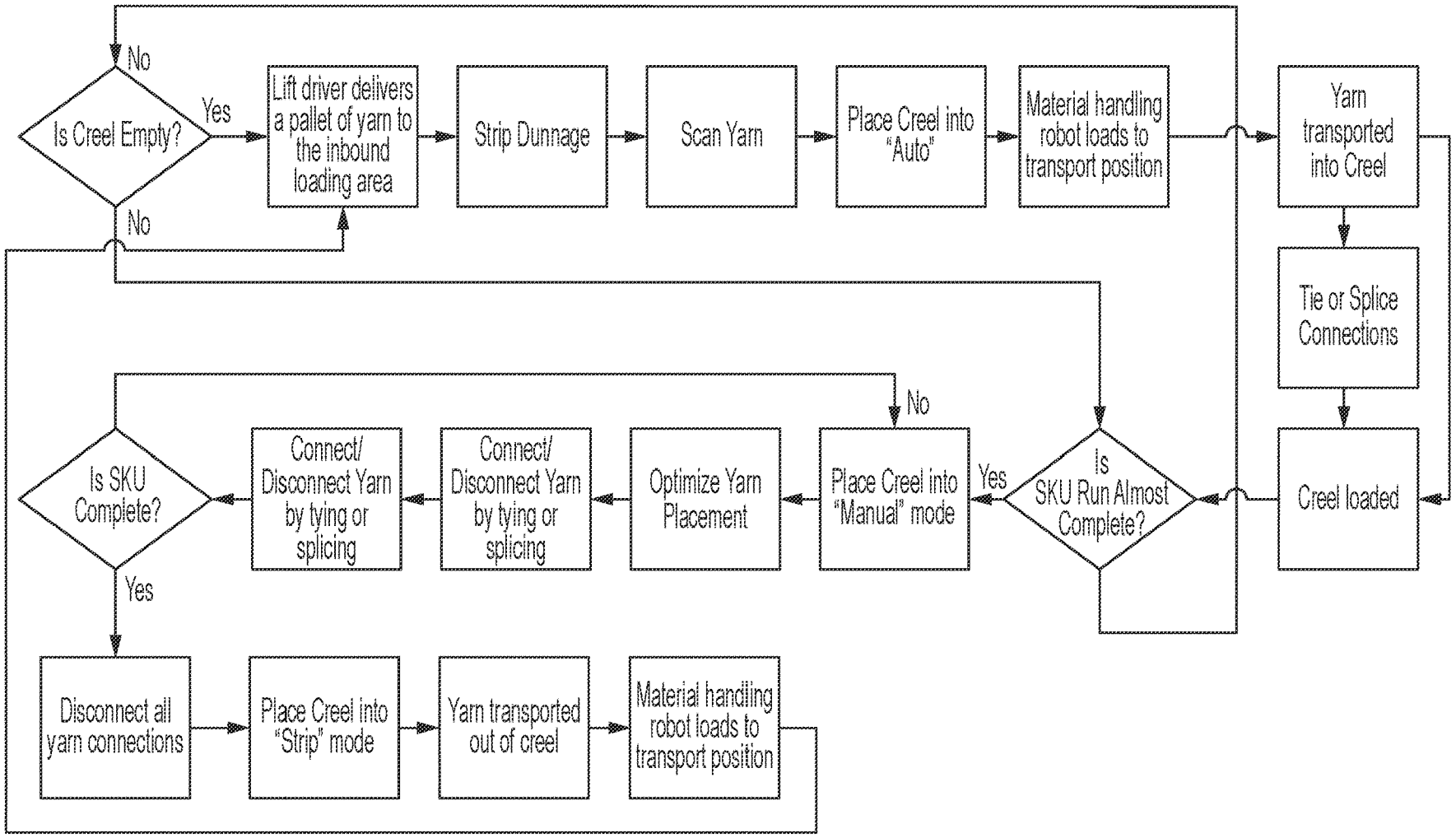
FIG. 4 is a flowchart depicting an exemplary method of using a creel assembly as disclosed herein.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a gripper" can include two or more such grippers unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

Optionally, in some aspects, when values are approximated by use of the antecedent "about" or "generally" or "substantially," it is contemplated that values within up to 15%, up to 10%, or up to 5% (above or below) of the particularly stated value or characteristic can be included within the scope of those aspects.

As used herein, the terms "optional" or "optionally" mean that the subsequently described event or circumstance may or may not occur, and that the description includes instances where said event or circumstance occurs and instances where it does not.

Disclosed herein with reference to FIGS. 1-4 is a creel assembly 500 having an outer wall 502, a plurality of yarn package engagement locations 504, a multi-axis robot 506, and at least one processor. The outer wall can define an interior space 508, and the plurality of yarn package engagement locations 504 can be distributed within the interior space. It is contemplated that the outer wall of each creel assembly 500 can be provided in any desired shape, including, without limitation, a circular, square, octagonal, or pentagonal shape. The multi-axis robot can be fixedly secured within the interior space and positioned to selectively engage yarn packages within the interior space. Optionally, the multi-axis robot 506 can be provided on a pedestal. The multi-axis robot can be configured to selectively access the plurality of yarn package engagement locations. The at least one processor can be communicatively coupled to the multi-axis robot and configured to receive an input corresponding to a selected action by the multi-axis robot. Methods of using the creel assembly are also disclosed.

Also described herein are modular creel systems comprising a plurality of the disclosed creel assemblies, with each creel assembly serving as a respective creel module. Optionally, the modular creel systems can comprise an automated feeder assembly configured to selectively deliver yarn packages to the plurality of creel assemblies. Optionally, the plurality of creel assemblies can comprise at least two vertically stacked creel assemblies. Additionally, or alternatively, the plurality of creel assemblies can comprise at least two horizontally adjacent creel assemblies. Methods of using and assembling the modular creel systems are also disclosed.

In further aspects, it is contemplated that the modular creel system can comprise a plurality of creel assemblies that can be positioned in a first configuration during a first creeling (tufting or warping) operation and that can be positioned in a second configuration during a second creeling (tufting or warping) operation, with the first and second configurations being different from one another. In still further aspects, additional creel assemblies can be coupled to an initial group of creel assemblies in an additive fashion to expand a given creel system.

Additional details of the disclosed assemblies, systems, and methods are provided below.

Creel Design and Function

Structural Features

In exemplary aspects, the configuration of the creel will be standard, flexible, and modular to provide creel warping and tufting cells. In these aspects, it is contemplated that each creel assembly can function as a creel module.

Optionally, in further exemplary aspects, the disclosed creel assemblies can fit within a floor space of 42 feet wide by 49 feet long with a max ceiling height of 20 feet. In providing a modular creel, the creel's footprint can be expanded or shrunk, depending on the need. Accordingly, creels having smaller footprints can be provided.

Optionally, in further exemplary aspects, the multi-axis robot of each creel assembly can be a centrally-located servicing robot.

Optionally, in further exemplary aspects, the feeder assembly can comprise a robotic feeder assembly.

Optionally, in exemplary aspects, the multi-axis robot of each creel assembly can have a robotic arm mounted to the floor (e.g., using a base) or the ceiling (e.g., using a gantry) of the creel assembly. In these aspects, it is contemplated that the robotic arm can be configured to use 360 degree access to reach all yarn positions within the yarn assembly.

Optionally, in exemplary aspects, the creel system can be a multi-level system that can be added or subtracted onto to achieve a desired creel configuration for warping or tufting operations. It is contemplated that the number of stacked creel assemblies can be two or three, with most operations being conducted with a two-level stacked configuration.

Optionally, in exemplary aspects, upper levels of the disclosed creel systems can comprise catwalk linkages to adjacent creel assemblies. In use, it is contemplated that these catwalk linkages can allow operators to access multiple creel assemblies at the same level without having to climb up and down, thereby maximizing human labor efficiency and productivity.

Optionally, in exemplary aspects, upper levels of the disclosed creel systems can comprise a bolt on catwalk 520 surrounding the operating area and a mechanism (e.g., a ladder) for accessing the upper level from a lower level within the creel system.

Optionally, within each creel assembly, it is contemplated that a creel section (i.e., a vertical column of yarn package engagement locations) can be no more than 6 or 8 (even numbers) yarn cones high. It is contemplated that the use of a limited, even number of yarn cones in this fashion can allow for use of a dual or quad end effector (coupled to the robot arm) to make the loading/unloading process more efficient. Although creel assemblies as disclosed herein are not limited to cone-style packages, for the purposes of the disclosure it should be understood that the terms yarn cone and yarn package are used interchangeably herein.

In use, it is contemplated that the plant operator can selectively adjust the yarn package engagement locations and positions of creel assemblies to achieve a designated creel configuration, for example, by engaging a manual mode.

In one non-limiting example, it is contemplated that each creel level within a creel system can service at least 1,844 cone positions (a two-level can service at least 3,688 cone positions). However, it is contemplated that each creel level can be configured to service more or fewer cone positions depending upon the creel assembly configuration and space constraints.

Optionally, in exemplary aspects, the bases of the disclosed multi-axis robots are stationary.

Optionally, in further exemplary aspects, the disclosed creel assemblies and creel systems do not include or make use of vision systems.

In exemplary aspects, it is contemplated that all yarn cone locations (yarn package engagement locations) are fixed within a given creel assembly.

In further exemplary aspects, the creel operator 512 can have zoned access 510 from the perimeter of each yarn assembly to permit performance of tying and splicing tasks. It is contemplated that all non-maintenance access to the creel can be provided from outside the wall of the creel assembly. While one zone can have human interaction (an interface mode), other zones (optionally, all other zones within the creel assembly) can be in a running or operational order or mode. Within each creel level, the number of zones configured for human interaction can be selectively adjusted. Optionally, within each creel level, it is contemplated that the number of zones configured for human interaction can range from four to eight.

In exemplary non-limiting aspects, the disclosed robotic components can be manufactured by ABB or Yaskawa (Motoman).

In exemplary non-limiting aspects, it is contemplated that the disclosed creel assemblies and creel systems can comprise processing units, including programmable logic controllers (PLCs), to permit communication among the various system components. Optionally, such PLCs can be AB L83 PLCs manufactured by Allen Bradley.

In exemplary non-limiting aspects, it is contemplated that the disclosed creel assemblies and creel systems can comprise one or more drive systems for effecting movement of yarn packages. Optionally, such drive systems can be manufactured by Yaskawa.

In exemplary non-limiting aspects, it is contemplated that the disclosed creel assemblies and creel systems can comprise at least one human-machine interface (HMI) for receiving inputs from a creel operator. Optionally, such HMIs can be provided as a Siemens 22" Comfort Panel; however, it is also contemplated that portable HMIs such as tablets and other remote computing devices (e.g., smartphones) can be used.

In further exemplary aspects, each creel assembly can have a maintenance access door 514 to permit access to the stationary robot within the creel assembly. In these aspects, it is contemplated the maintenance access door can have an emergency stop protocol (e.g., an emergency stop switch that is triggered) if opened during operations. For example, all moving parts can be halted. It is further contemplated that the maintenance access door can be formed as a portion of the outer wall of the creel assembly such that the inner surface of the access door can be used as creel space.

In further exemplary aspects, it is contemplated that all yarn exit points can be oriented upwardly, with the yarn curving over the top of the outer wall of the creel assembly to bridge the distance between the creel assembly and the tufting and/or warping machine(s).

In still further exemplary aspects, it is contemplated that each creel level can have at least one status light (e.g., at least one Andon light) that is communicatively coupled to a processor and configured to provide an indication of a status of system automation. For example, the status light(s) can vary between on and off, vary between solid and flashing, vary in flashing frequency, and/or change color depending on the status.

Automation Operations

In use, cones of yarn (i.e., yarn packages) can be picked from an inbound pallet location. Optionally, machine vision can be used to effectively find cones of yarn on a pallet and place them on an inbound system such as a conveyor.

In exemplary aspects, as each yarn cone is picked off the pallet, a plastic cap, as known in the art, can be installed on the yarn cone.

In further exemplary aspects, cones of yarn fed into the creel can be provided with indicia that can be scanned to verify lots of yarn and consumption amounts/rates. It is contemplated that this can be done within the creel or outside of the creel via auxiliary automation.

In further exemplary aspects, the robot within each creel assembly can comprise an end effector that loads multiple cones at a time. Optionally, the end effector can be a dual, tri, or quad end effector. It is contemplated that the creel assembly can have a singular end effector to manipulate around the yarn in process.

In use, after cones are placed into the package creel transport mechanism (as further disclosed herein), the robot can place plastic caps onto the ends of the yarn package.

In exemplary aspects, a programming interface can be provided to receive one or more inputs corresponding to a proper creel configuration. In these aspects, it is contemplated that locations of the cones and creel population configurations can be stored in memory and associated with particular processes and operations.

For a multilevel creel system (at least two stacked modular systems), an electro mechanical dumbwaiter can be bolted or otherwise secured onto the exterior of the creel. The dumbwaiter can comprise a platform that selectively moves vertically along the creel. It is contemplated that the dumbwaiter can be configured to deliver a selected number of yarn packages (e.g., four yarn packages) at a time. Optionally, it is further contemplated that the creel system can comprise a light (e.g., an Andon light) that provides a visual indication when the dumbwaiter is in service and safety protocol to prevent human injury. However, it is contemplated that other visual indicators and safety protocols can be used.

In further exemplary aspects, a separate scanner or camera can be provided with the end effector and configured to produce an alert or signal indicative of a yarn cone position that is empty and/or in need of prompt attention. In use, it is contemplated that the alert or signal can be received by the processing units within the automated yarn system as disclosed herein. It is further contemplated that the alert or signal can be received by a creel operator (optionally, through a remote computing device accessed by the operator).

In operation, during idle time, the robot of each yarn assembly can be configured to continually scan for empty cone positions. During an "Auto" mode, the robot can be configured to replace an empty yarn cone without prompting from a creel operator. During a "manual" mode, the operator can be responsible to make a decision and to provide at least one input directing the replacement of a cone of yarn or a swap between yarn cone positions.

After the cones of yarn are depleted, the robot can be configured to remove the cones and place them in a location to be removed from the cell via conveyance or a gravity chute, or placed into a container by a service robot.

Optionally, in exemplary aspects, the yarn system can comprise collision prevention systems provided on the robotic arms to detect if a human mistake is made and the robot tries to load a position that is already loaded. Additionally, in these aspects, if the robot goes to pick up a cone of yarn and there is not one there, the robot can be configured to scan for a minimum cone diameter in order to evaluate and confirm whether there is no yarn present. In both of these conditions, the robot can be configured to enter a fault condition and provide feedback on the HMI to prompt manual intervention by a creel operator.

Human Interaction

A human interface can be provided as a remote computing device (e.g., tablet, portable electronic pad, smartphone, or the like) or other conventional HMI device. In use, the human interface can allow a creel operator to make manual changes of yarn positions for optimization of the creel and to minimize waste of yarn. Logic within the creel can maintain track of cone locations and alert the creel operator if they assign a populated location mistakenly.

In use, creel operators can manually tie or splice ends of yarn together. It is contemplated that these creel operators can be provided with zoned access from the perimeter of the wall of each creel assembly. While a creel operator is within a particular zone, the robotic arm can continue to service the other zones of the creel assembly (module) (i.e., except for where the zoned section is interrupted for manual work, operations within the creel assembly will continue).

In operation, it is contemplated that the HMI interface can display live positions of yarn within the creel. Optionally, in these aspects, the monitoring of live positions of yarn can be done with logic and not sensors. Although not preferred due to complexity and the number of sensors necessary to track yarn locations, it is contemplated that sensors can be used as well.

In exemplary aspects, each creel assembly can have a display monitor (optionally, a 55" monitor) to show the live view and live status of all creel locations with picture-in-picture (PIP) of one or two cameras within the creel assemblies to permit monitoring of activity inside the operating area. Optionally, it is contemplated that each creel can have remote viewing, monitoring, and diagnostic capability.

Yarn/Cone Characteristics

In exemplary non-limiting aspects, each creel location can be configured to accommodate a cone of yarn up to 15" in diameter.

Optionally, each cone can have a 2.75" inside diameter and a 3-⅛" outside diameter.

Optionally, each yarn cone can be 11-7/16" in length.

Optionally, the automation disclosed herein can be configured to handle up to a 25 lb cone of yarn at each yarn cone position. Optionally, in some aspects, a dual end effector can have a 50 lb capacity. If a tri end effector is used, it is contemplated that the end effector can have a 75 lb capacity. If a quad end effector is used, it is contemplated that the end effector can have a 100 lb capacity.

Complexity of the Creel

In exemplary aspects, it is possible for the creel to have a plurality (e.g., 4-6) of different types of yarns loaded into the creel at the same time. In these aspects, it is contemplated that the programming logic of the creel can allow a creel operator to load the creel in any configuration within the total number of yard positions.

In further exemplary aspects, each cone of yarn can be verified via scanning an associated barcode (or other indicia) prior to entering the creel.

In still further exemplary aspects, the HMI can keep track of the yarn ID on the display (screen) for the operator to know what yarn type is running in a particular location within the creel.

In operation, the HMI can provide the ability to do yarn optimization in either a manual fashion or using automated processor control. Optionally, in one example, the HMI can be configured to permit movement of yarn cones from one position to another position in a manual fashion to provide optimization near the end of a tufting run.

Process Flow

Loading the Creel-Run Mode

An exemplary loading process can begin with a lift driver or AGV delivering a pallet of yarn to a fixed inbound/outbound position 530. The dunnage can be stripped and discarded by manual labor. The HMI can be set to operate in an "Auto" mode and used to load the creel. A material handling robot 532 can locate each package of yarn and load the yarn package into the proper position for transport into the creel. If the robot discovers nonconforming packages, the system can produce an alarm and alert the creel operator to remove the package of yarn. The material handling robot can place plastic caps onto the packages before entry into the creel. Once a pallet has been completely loaded, the material handling robot can generate an alarm and call for an additional pallet of yarn; alternatively, an additional pallet can be automatically indexed into position for engagement with the material handling robot. In exemplary aspects, yarn delivery can be staged on a conventional conveyor 534 or a just-in-time (JIT) delivery conveyor. Once the pallet is empty, the pallet can be transported to an outbound position for take-away. The loaded yarn can then be transported into the creel using the conveyor assembly. Optionally, it is contemplated that the walls of the creel assemblies can be provided with one or more openings for receiving portions of the conveyor assembly and permitting delivery of yarn packages to a location that is accessible from the robots within the interior spaces of the creel assemblies. Human creel operators can make all yarn connections to ensure that each yarn cone is connected to the tufter.

During Creel Operations

When the automation components of a creel assembly (creel module) are in an "Auto" mode, the automation can be configured to load a package of yarn (received from the conveyor assembly) onto a selected position within creel assembly in the same general manner in which yarn packages are loaded by the material handling robot. During operation, the robot within each creel assembly, when in "Auto" mode, can be configured to use a scanning end effector to look for empty cones of yard and deposit them into an ejection shoot.

If the creel assembly is in "Manual" mode, then the HMI and Andon lights can prompt the operator to give instruction to move a cone of yarn from one position to another or to load a new cone automatically. It is contemplated that this process can be employed to optimize yarn usage. In exemplary aspects, it is contemplated that human creel operators can connect or disconnect all yarn connections to ensure that no cones are pulled out of the tufter.

Stripping the Creel-Run Mode

In further exemplary aspects, human creel operators disconnect all yarn connections to ensure that no cones are pulled out of the tufter. After a yarn cone is disconnected, the HMI can be placed in "Strip" mode to strip the creel. In this mode, yarn is transported out of the creel, and all leftover cones of yarn can be transported by the material handling robot to the outbound position. As the pallets become full, a lift driver or AGV can remove the full pallet and replace the full pallet with an empty pallet for loading additional yarn cones.

Once the creel is empty, the system can be configured to alert the HMI that the creel is empty and turn on a light (e.g., an Andon light) or other visual indicator to ready itself for loading.

Creel Module

Figure 5:
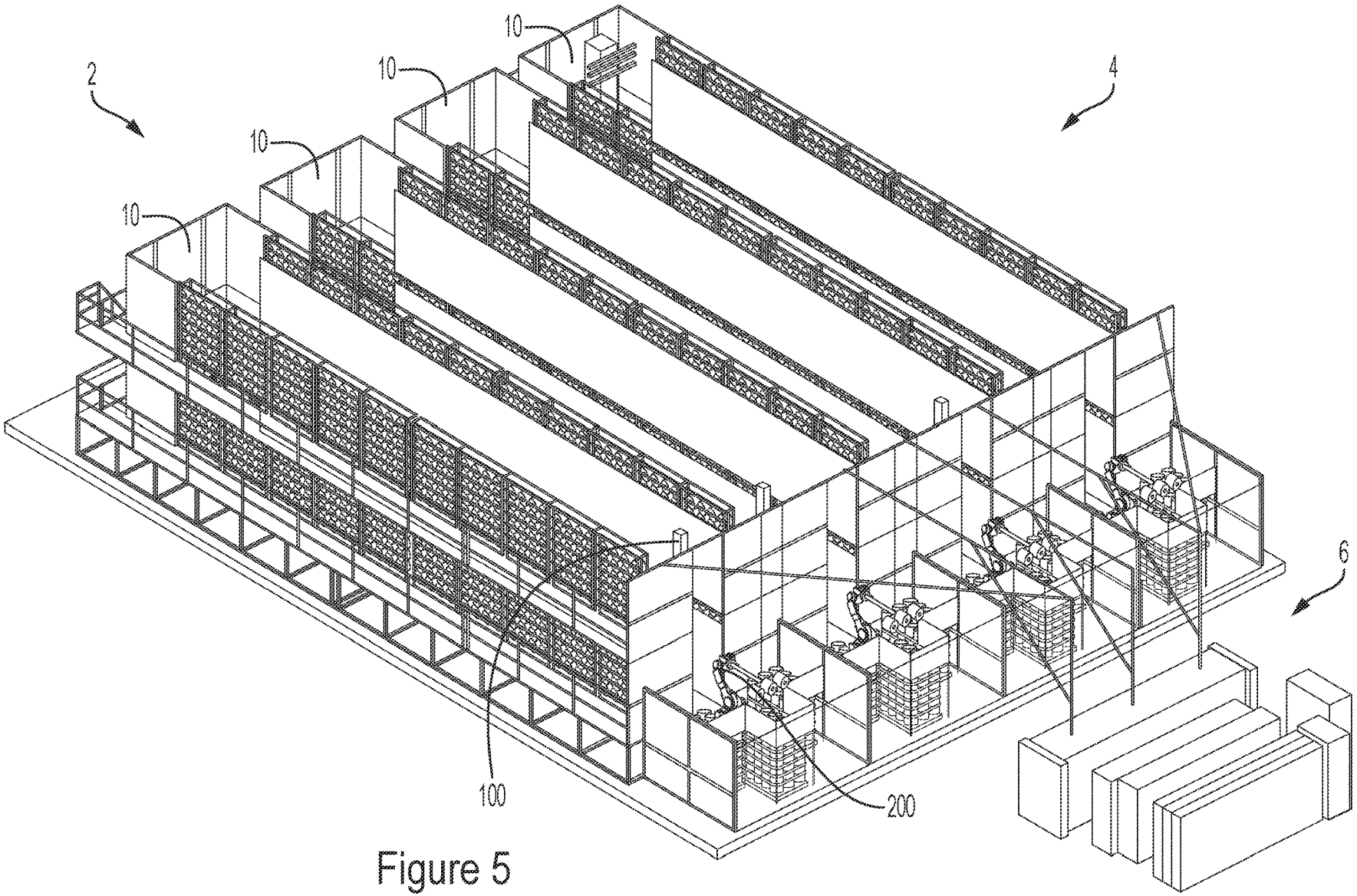
FIG. 5 is a perspective view of a textile manufacturing system comprising a modular creel system and a warper in accordance with embodiments disclosed herein.
Figure 6:
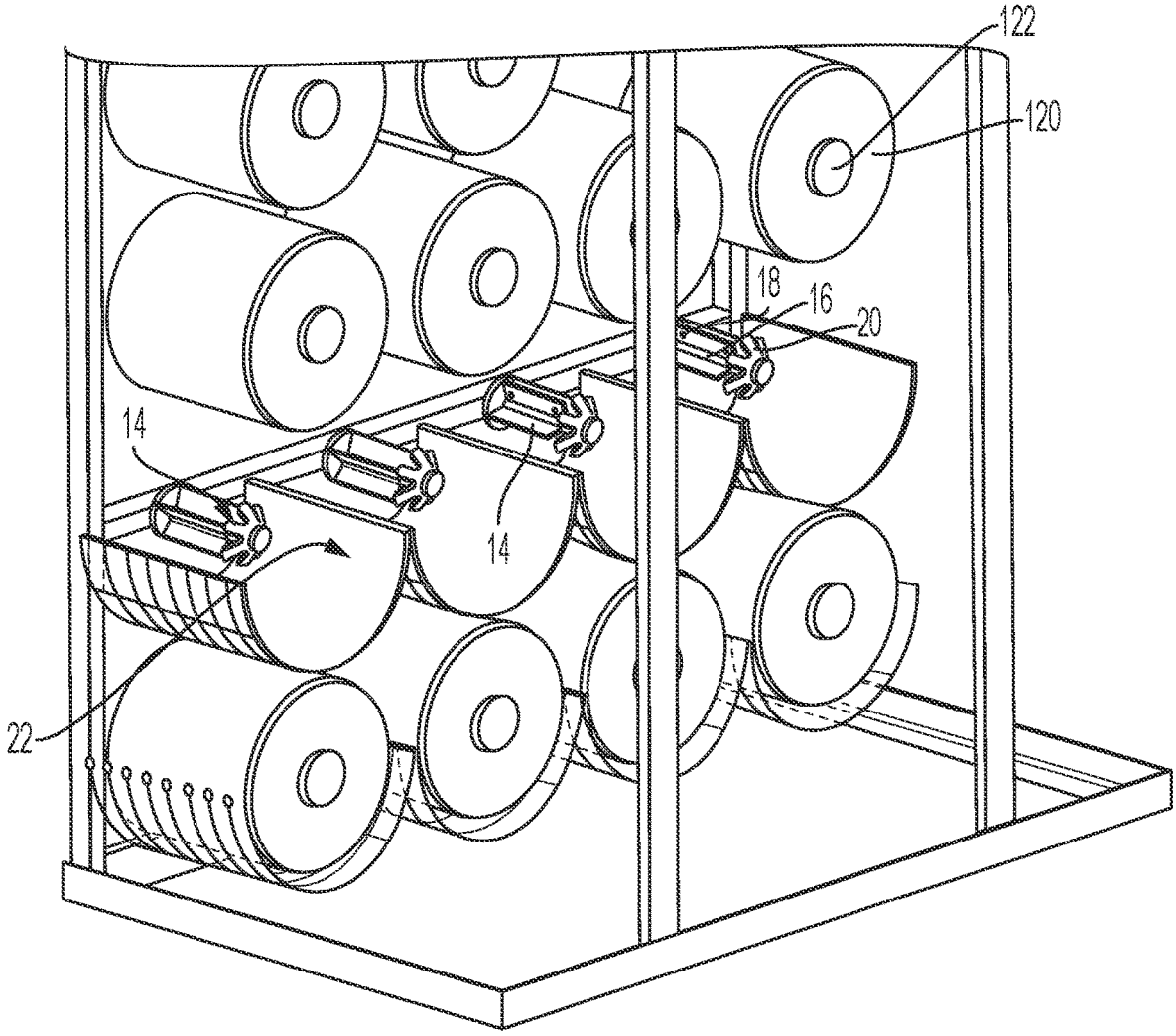
FIG. 6 is a perspective view of a portion of a creel of the modular creel system of FIG. 5.

Referring to FIGS. 5 and 6, a textile manufacturing system 2 can comprise a creel 4 and a warper 6 or other yarn processing apparatus such as a tufter or a heat set tunnel. The creel 4 can comprise a plurality of creel modules 10. Each creel module 10 can comprise an outer wall 12 and a plurality of yarn package engagement locations 14. The yarn package engagement locations 14 can be bullhorns 16 that comprise a generally cylindrical portion 18 and a spreader 20 that biases outwardly against an interior of a yarn package in order to retain the package on the yarn package engagement location. Pull-off guides 22 (e.g., half-cylindrical pull-off guides) can be axially aligned with, and positioned below, the bullhorns 16.

Creel System

Figure 7A:
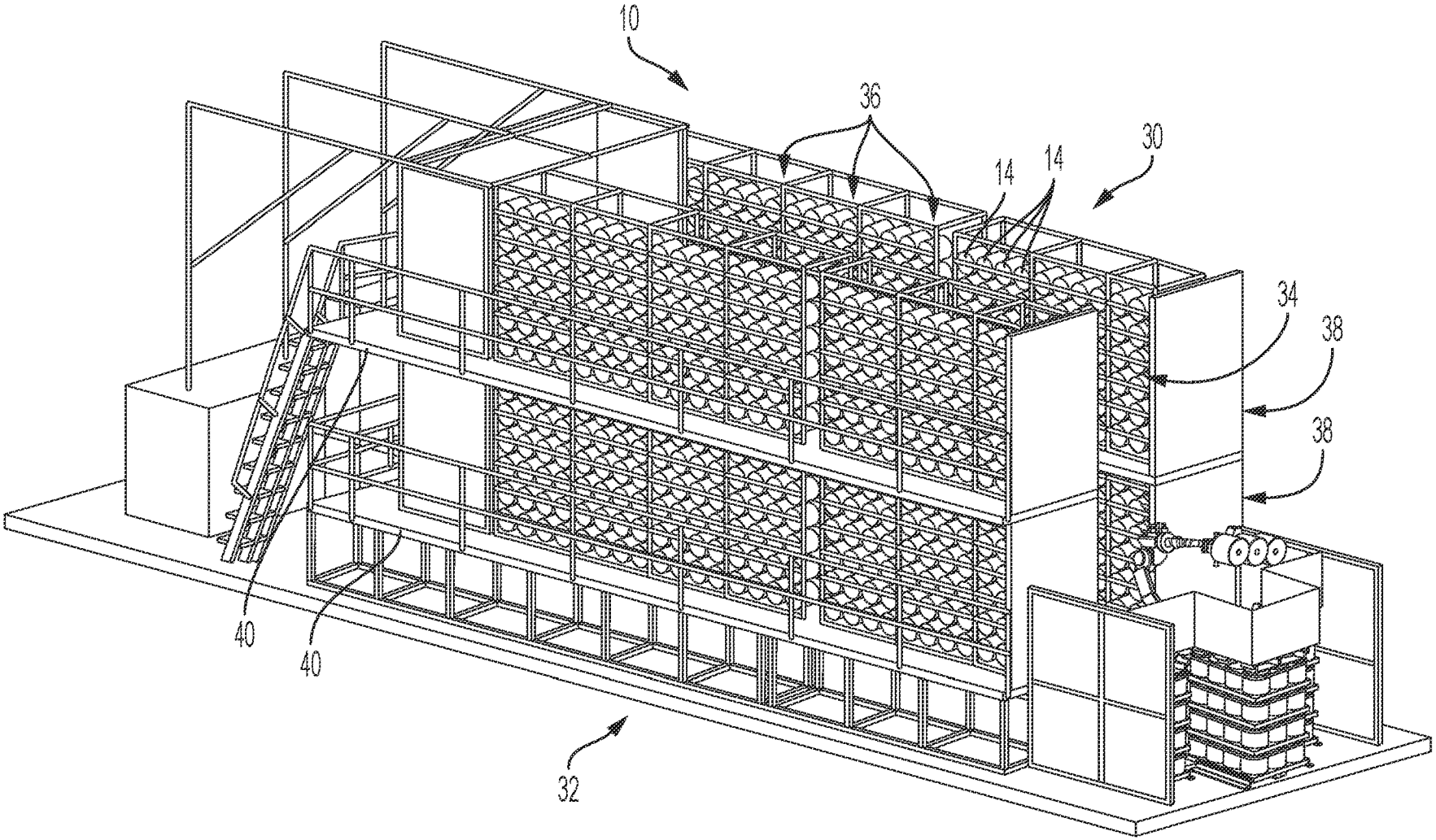
FIG. 7*a* is a perspective view of a creel module of the creel of FIG. 6.
Figure 7B:
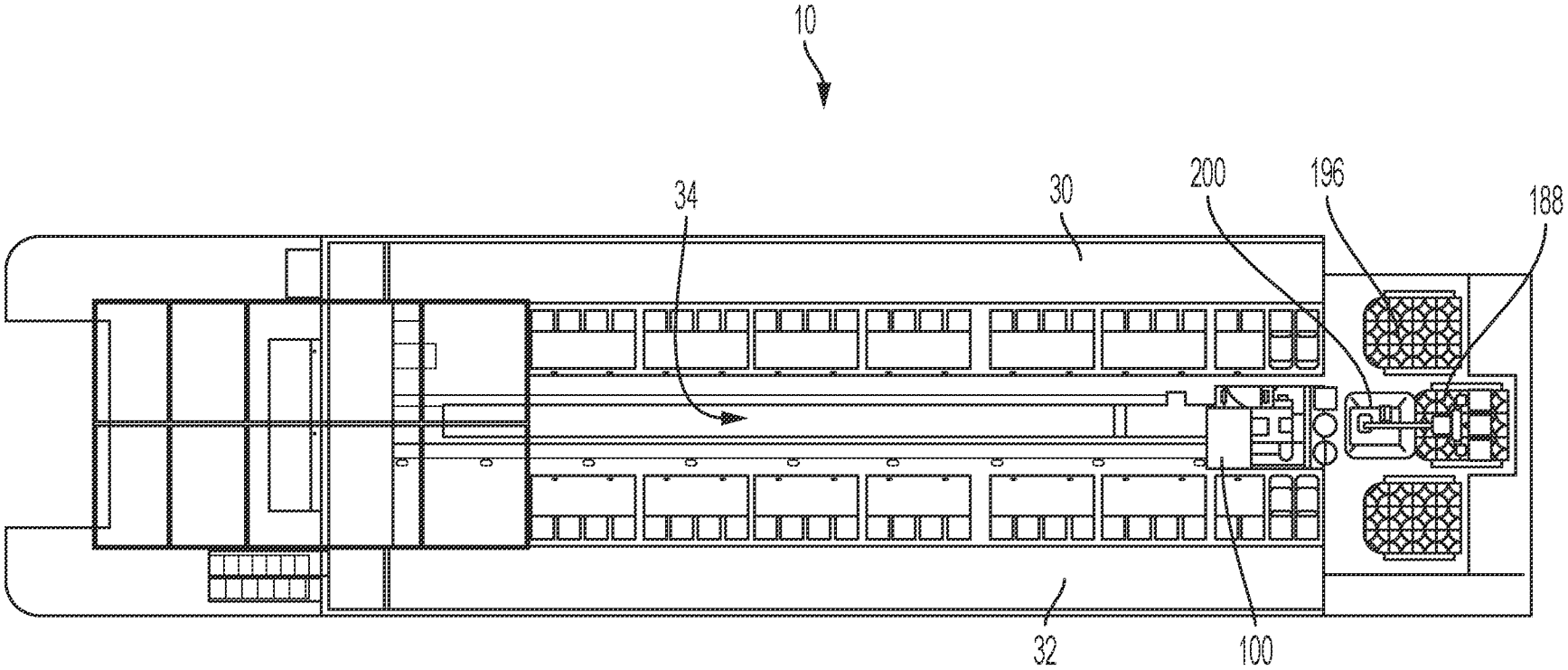
FIG. 7*b* is a top view of the creel module of FIG. 7*a*.

One or more creel modules can cooperate to form a creel 4 that feeds a yarn processing apparatus. According to various embodiments, a creel can comprise a plurality of modules (e.g., between one and twenty modules). Referring also to FIGS. 7*a* and 7*b*, each creel module 10 can comprise a first side 30 and an opposing second side 32, wherein the first side 30 and second side 32 are spaced by a passage 34 through which a gantry travels as further disclosed herein. Each side can comprise a plurality of sections 36 (e.g. between two and twenty sections). Each section can comprise a plurality of horizontal rows (e.g., between six and twenty rows) and a plurality of vertical columns (e.g., four columns) of yarn package engagement locations 14. Optionally, each section can be positioned between respective horizontal separators of the frame of the creel as shown in FIGS. 7*a*-7*b*. Each module can comprise one or a plurality of levels 38. A catwalk 40 at each level 38 can provide operators with access to the creel.

Figure 8:
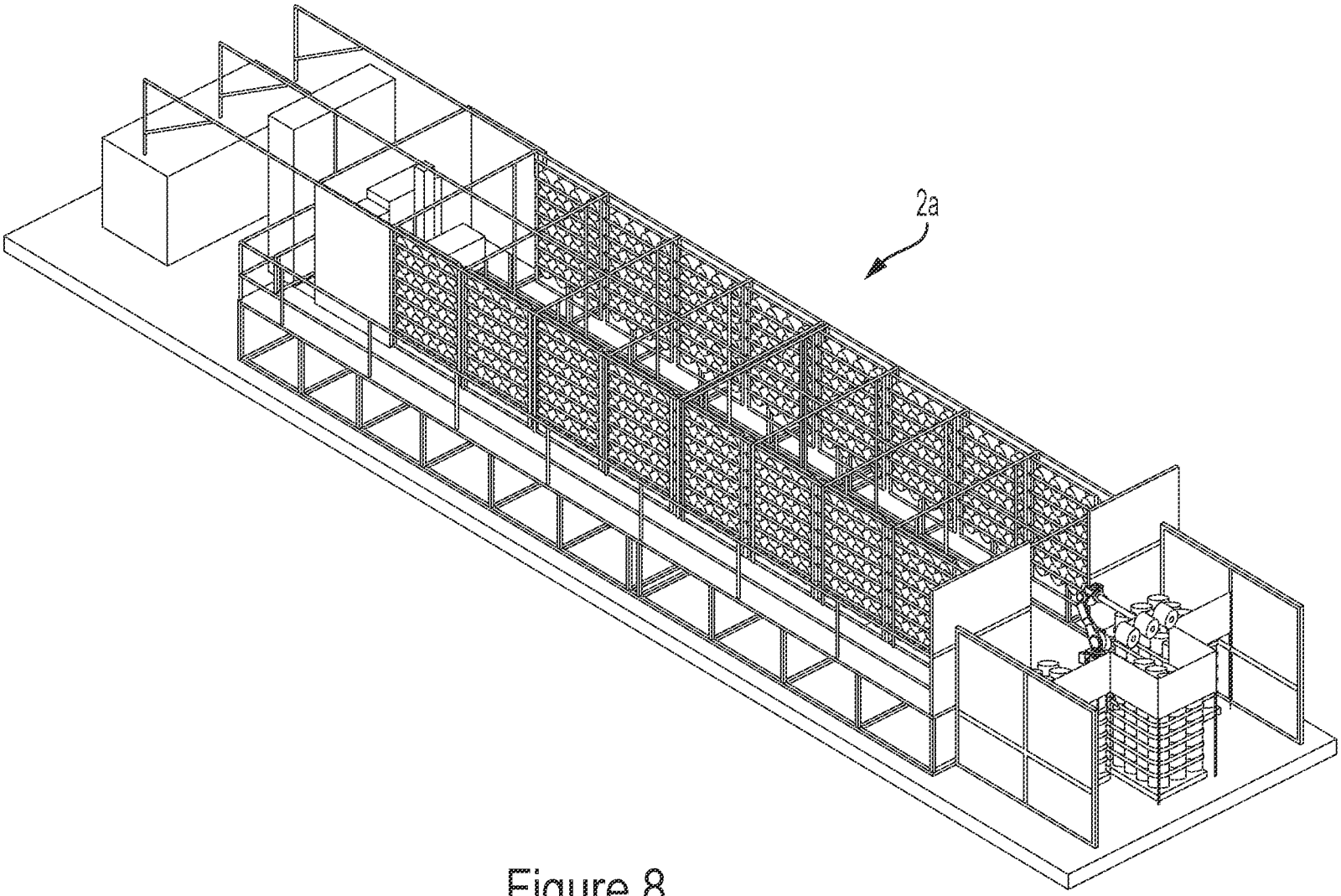
FIG. 8 is a perspective view of an exemplary warper system comprising a single creel module.
Figure 9:
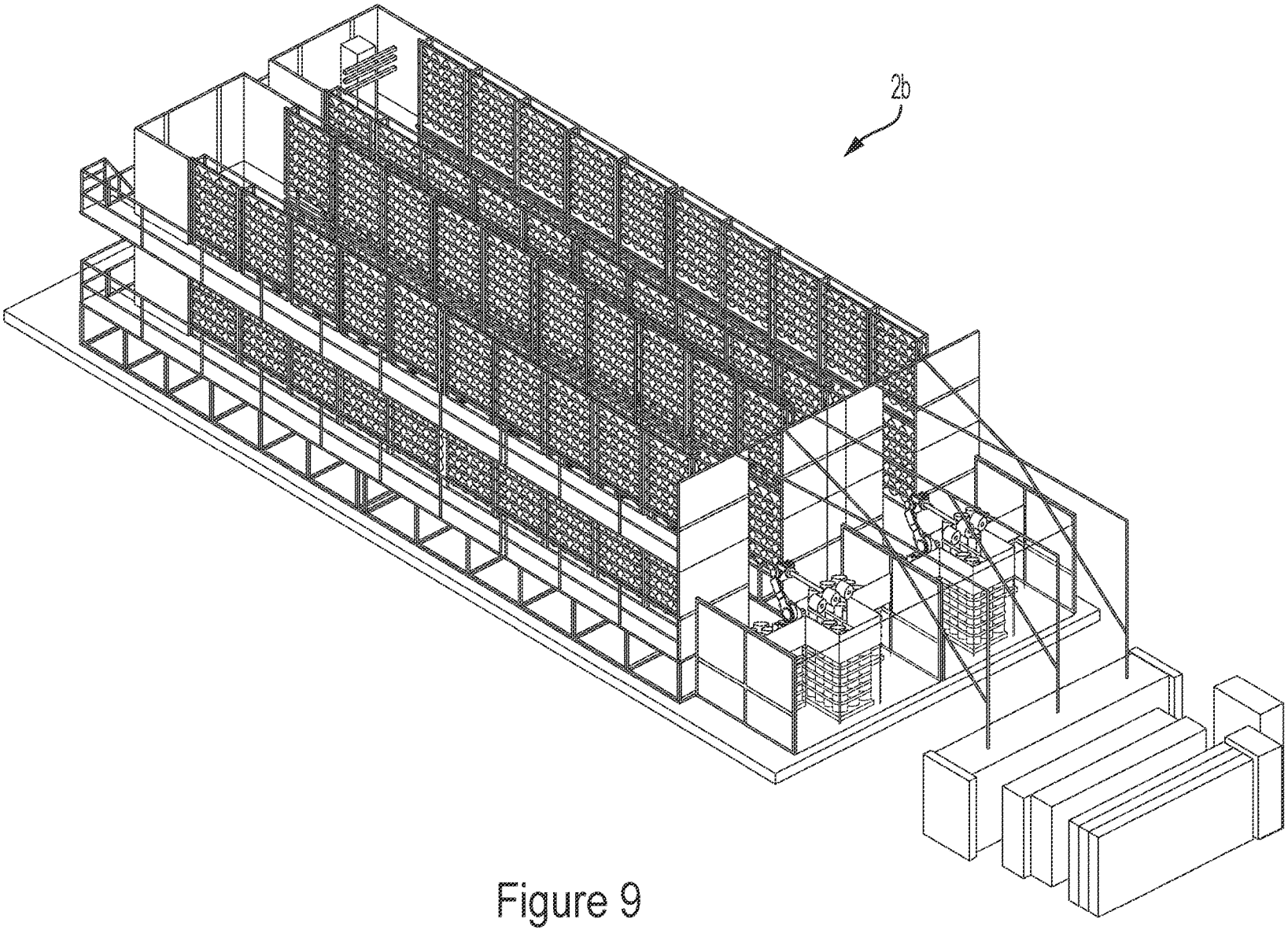
FIG. 9 is a perspective view of an exemplary tufting system comprising two creel modules.
Figure 10:
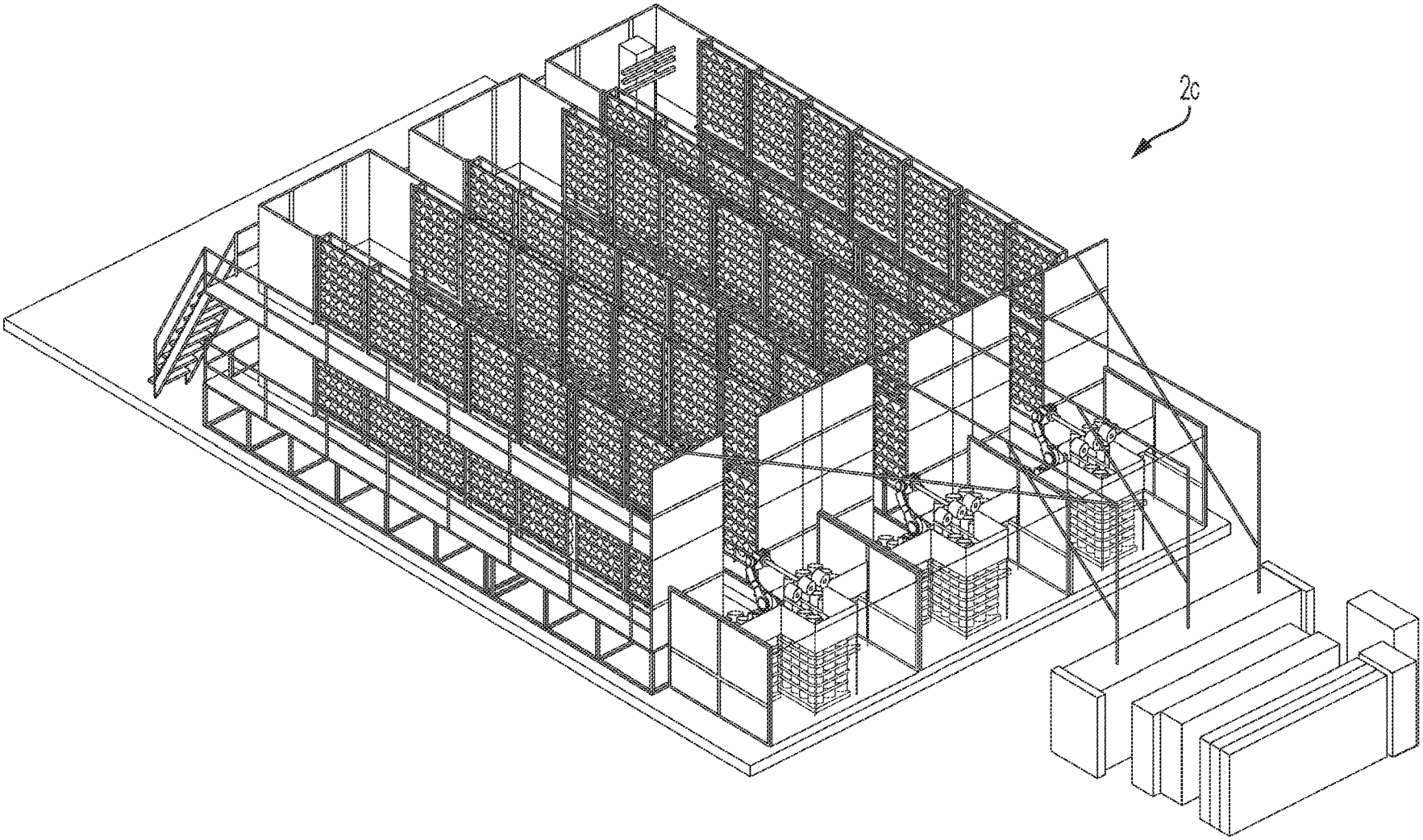
FIG. 10 is a perspective view of an exemplary tufting system comprising three creel modules.
Figure 11:
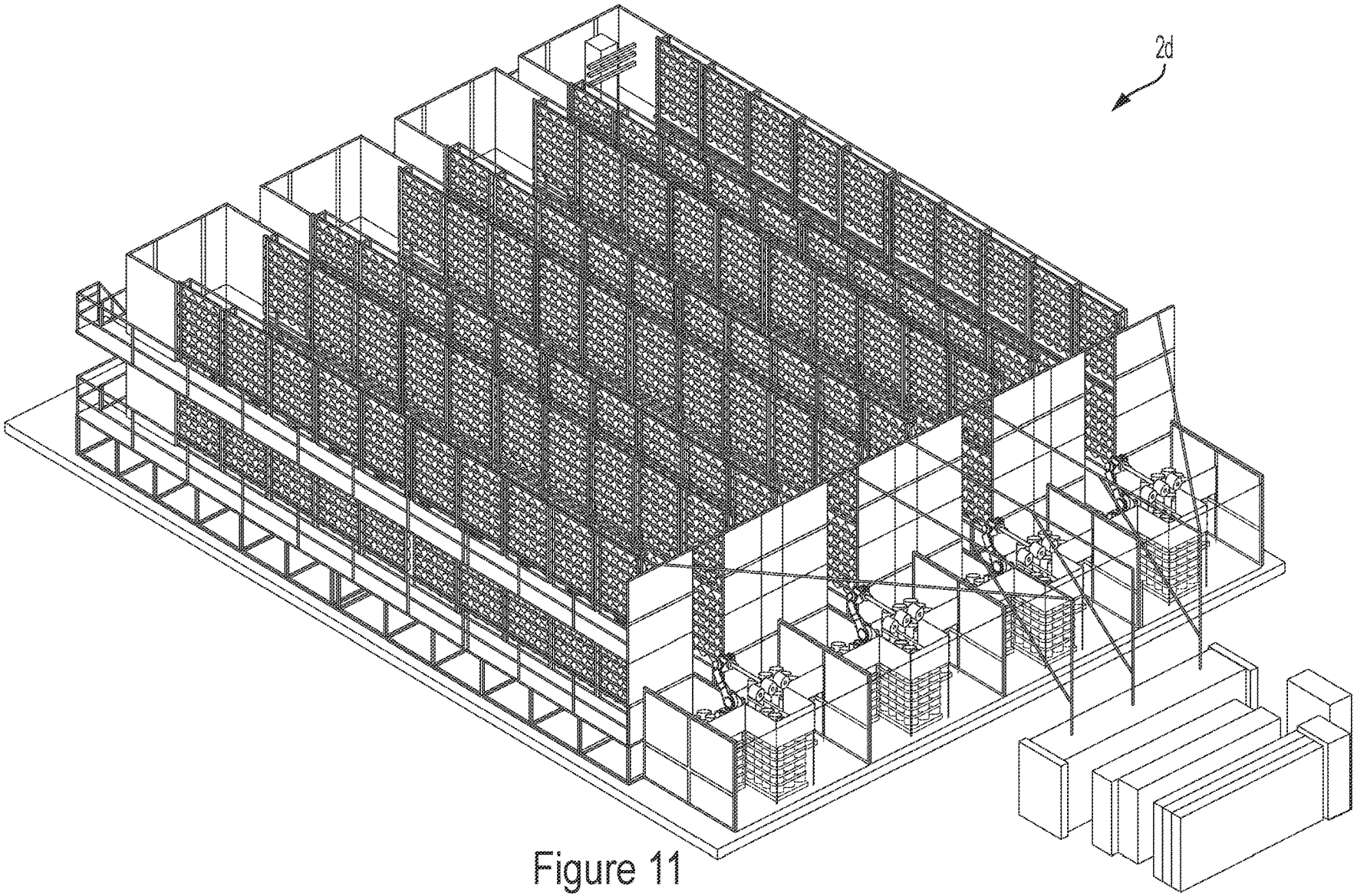
FIG. 11 is a perspective view of an exemplary tufting system comprising four creel modules.

Referring to FIG. 8, in a first embodiment, a warper system 2*a* can comprise a single creel module 10. Optionally, the single creel module 10 can be two levels high, with eight sections per side. The single creel module 10 can hold 640 packages, or 320 ends, that are connected to a warper 6. Referring to FIG. 9, in a second embodiment, a tufting system 2*b* can comprise a pair of creel modules 10. The pair of creel modules 10 can be two levels high and have ten sections per side. The pair of creel modules 10 can, in combination, hold 1844 packages, or 922 ends, that are connected to a tufting machine. It is contemplated that two packages can be connected so that as a first package that is attached to a given needle becomes exhausted, the second (transfer) package can continue to provide yarn to the needle. Referring to FIG. 10, in a third embodiment, a tufting system 2*c* can comprise three modules 10. The tufting system can be two levels high with five sections per side. The three creel modules 10 can, in combination, hold 1844 packages, or 922 ends, that are connected to a tufting machine. Referring to FIG. 11, in a fourth embodiment, a tufting system 2*d* can comprise four modules 10. The tufting system can be two levels high, with ten sections per side.

The tufting system can hold 3688 packages, or 1844 ends, that are connected to a tufting machine. In a fifth embodiment, a yarn creel system can comprise a single module one level high with eight sections per side that can hold 640 packages, or 320 ends, that are connected to a heat set tunnel. In some embodiments, a plurality of creel modules 10 can be coupled to form an enlarged creel, for example, to perform a tufting operation. At least one of the plurality of creel modules can be decoupled from the other creel modules of the plurality of creel modules after the tufting operation to form a smaller creel (with fewer creel modules). Due to the modularity of the creel system, further creel module combinations can be provided as desired.

Gantry

Figure 12:
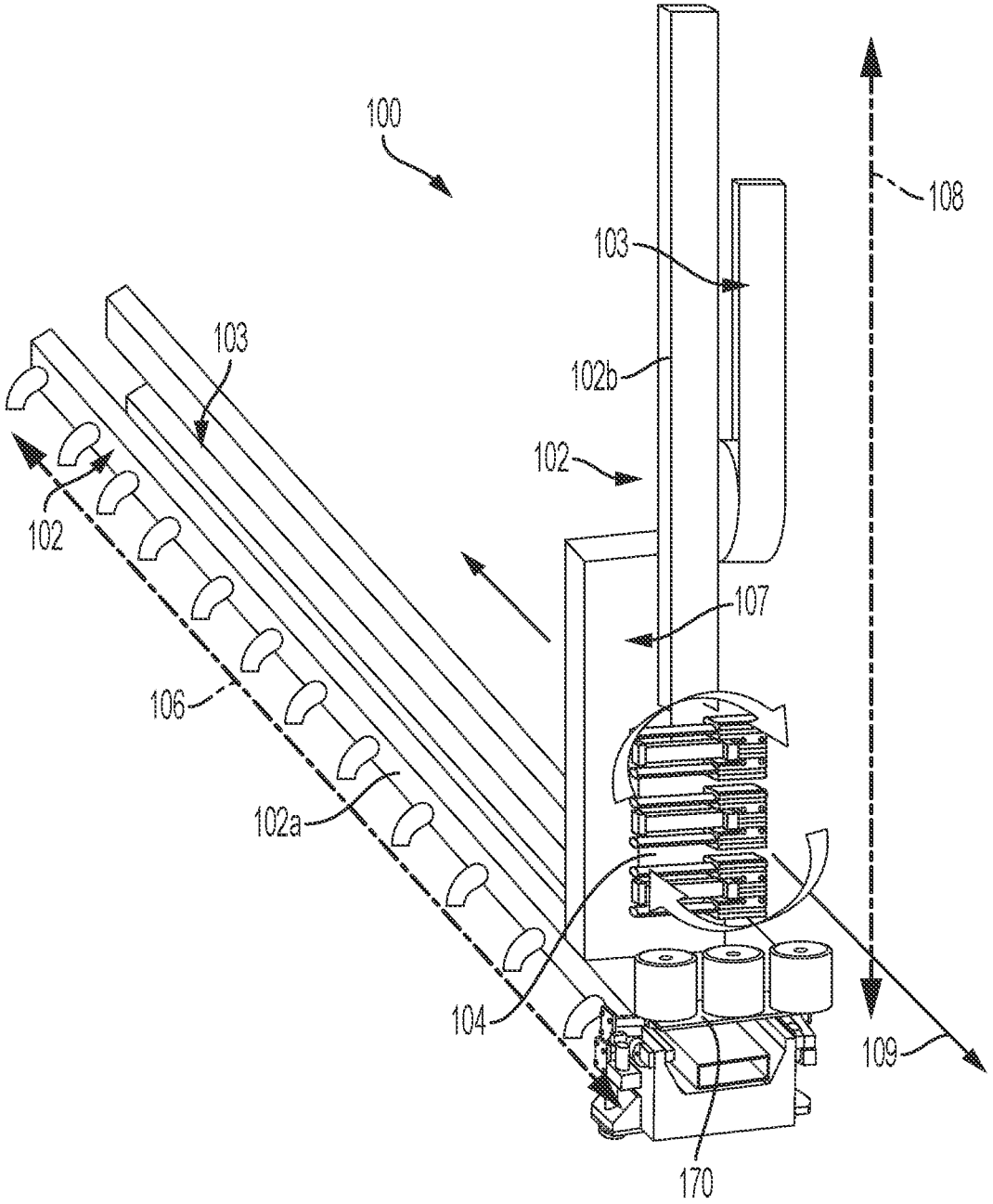
FIG. 12 is a perspective view of a gantry for use with the modular creel system of FIG. 5.
Figure 13:
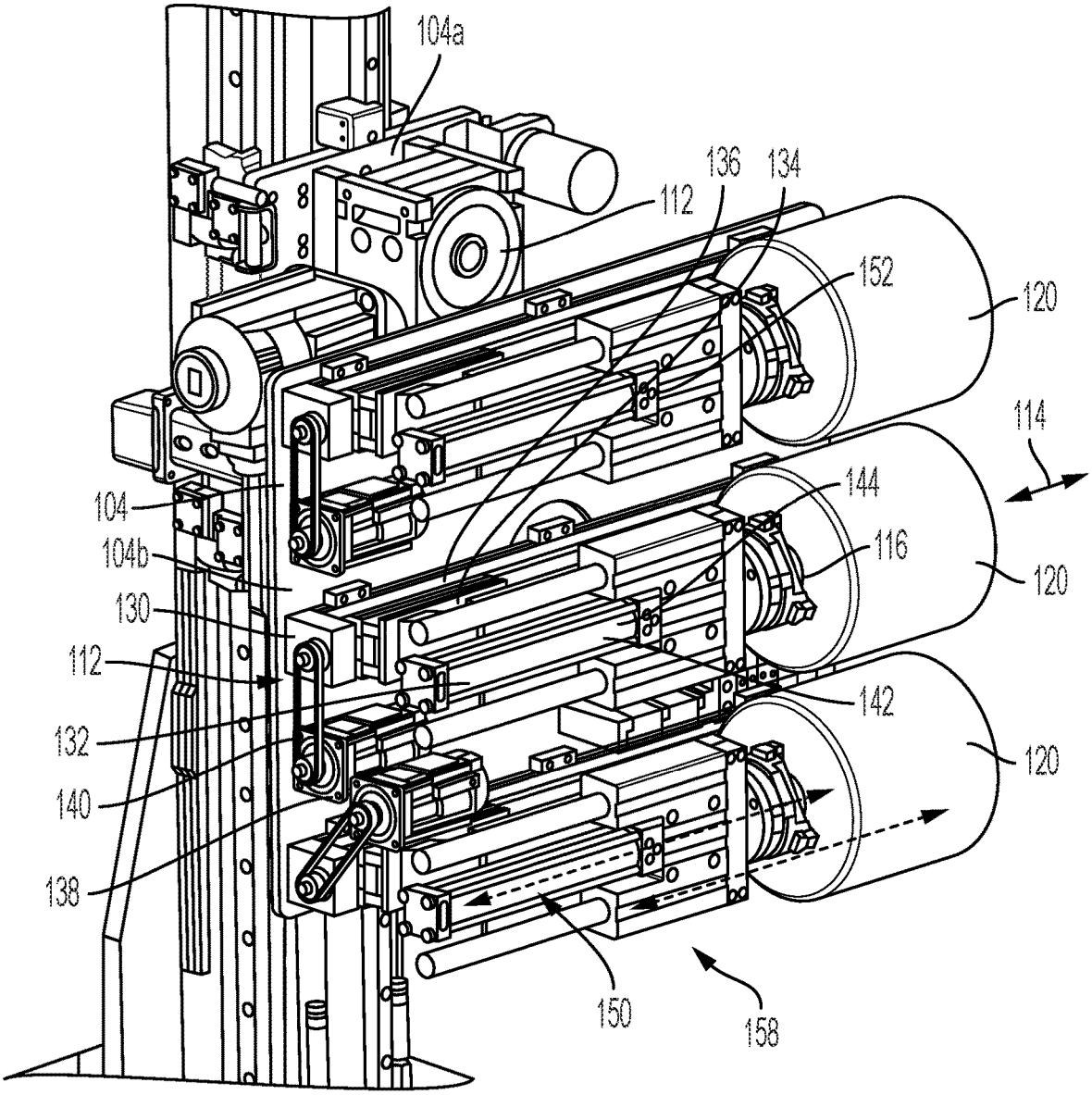
FIG. 13 is a perspective view of a portion of the gantry of FIG. 12.
Figure 14:
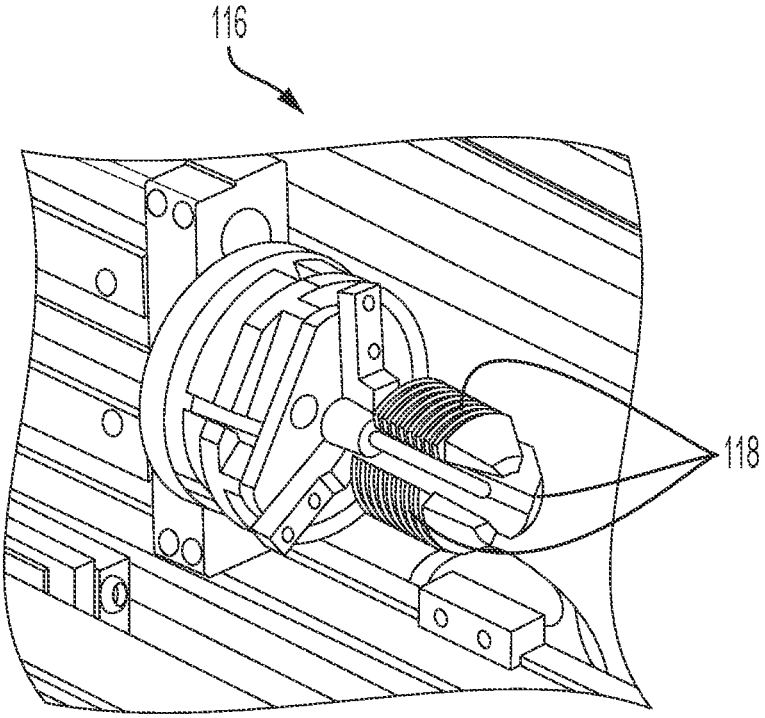
FIG. 14 is a perspective view of a gripper of the gantry of FIG. 12.

Each creel module 10 can have a respective creel loading apparatus. Referring to FIGS. 12 and 13, a creel loading apparatus, or gantry 100, can comprise a frame 102. The frame 102 can comprise a horizontal track 102*a* and a mast 102*b* that is movable via a motor (e.g., a servo motor) on the horizontal track 102*a* along a first axis 106. The frame 102 can include integrated conduits 103 for providing power, air, and a vacuum source. A platform 104 can comprise a first portion 104*a* that moves vertically, via a motor (e.g., a servo motor), along the mast 102*b*. Thus, the platform 104 can be movable along the frame relative to the first axis 106 and a second (vertical) axis 108. The platform can further comprise a second portion 104*b* that is rotatable with respect to the first portion 104*a* about a rotary axis 109 that is parallel to the first axis 106. A rotary actuator 112 can be configured to rotate the second portion 104*b* of the platform 104 about the rotary axis 109. A gantry control panel 107 can attach to the mast 102*b*.

A first linear actuator 112 can be attached to the second portion 104*b* of the platform 104. The first linear actuator 112 can be extendable along a linear actuator axis 114. A gripper 116 can attach to an end of the first linear actuator 112. Optionally, the gripper 116 can be provided as a component of end of arm tooling (EOAT). The gripper 116 can comprise a plurality of jaws 118 that extend radially from each other in order to grip an inner surface 122 (FIG. 6) of a yarn package 120. The plurality of jaws 118 can optionally have cylindrical surfaces. Thus, the gripper 116 can optionally define a cylindrical surface.

The linear actuator can comprise a first stage 130 and a second stage 132. The first stage 130 can comprise a sub platform 134 that is movable on a track 136 along the linear actuator axis 114. A servo motor 138 can drive a belt 140 to move the sub platform 132 along the track 136. The second stage 132 can comprise a pneumatic actuator 142 that is attached to the sub-platform 132 so that movement of the first stage 130 translates the pneumatic actuator 142 along the linear actuator axis 114. The pneumatic actuator 142 can comprise a pneumatic cylinder 144 having a piston rod 146 therein. The gripper 116 can attach to a distal end of the piston rod 146.

As further disclosed herein, a service robot can stage yarn packages in a staging area within the creel, and the gantry can then transport the yarn packages from the staging area to desired yarn package engagement locations on the creel. In order to be more accessible to the service robot, the staging area can be set closer to a central plane that includes the first axis 106 and the second axis 108. Thus, the first stage 130 can position the grippers in a first transverse position, relative to a transverse horizontal axis that is perpendicular to the first axis 106, from which the grippers can selectively access, via extension of the second stage 132, yarn packages in the staging area. The first stage 130 can then position the grippers in a second transverse position relative to the transverse horizontal axis from which the grippers can selectively position, via extension of the second stage 132, yarn packages on yarn package engagement locations on the creel.

Moreover, the dual stage actuator can enable the gantry to be configured for use in various creel module widths (i.e., the horizontal dimension perpendicular to the creel module's longitudinal dimension). For example, the first stage 130 can be set at a fixed position during normal operation, and the second stage 132 can be used for placing the yarn packages. Additionally, the first stage's position can be adjusted to improve positioning of the yarn packages with respect to the yarn package engagement locations when the second stage 132 is fully extended.

In some embodiments, a second linear actuator 150 and a third linear actuator 152 can attach to the second portion 104*b* of the platform 104, wherein each of the second linear actuator and the third linear actuator has the same construction and configuration as the first linear actuator 112. Each of the second linear actuator 150 and the third linear actuator 152 can have a gripper 116 attached at a distal end. In this way, the gantry 100 can manipulate three yarn packages 120 at a time. Each of the first linear actuator 112, the second linear actuator 150, and the third linear actuator 152 can be independently actuatable. Additionally, the first linear actuator 112, the second linear actuator 150, and the third linear actuator 152 can be movable in concert (i.e., simultaneously or sequentially). In further embodiments, the gantry can comprise two, four, five, or more linear actuators and respective grippers can independently manipulate a corresponding number of yarn packages. The linear actuators and respective grippers can collectively be referred to as end effectors 158.

Figure 17:
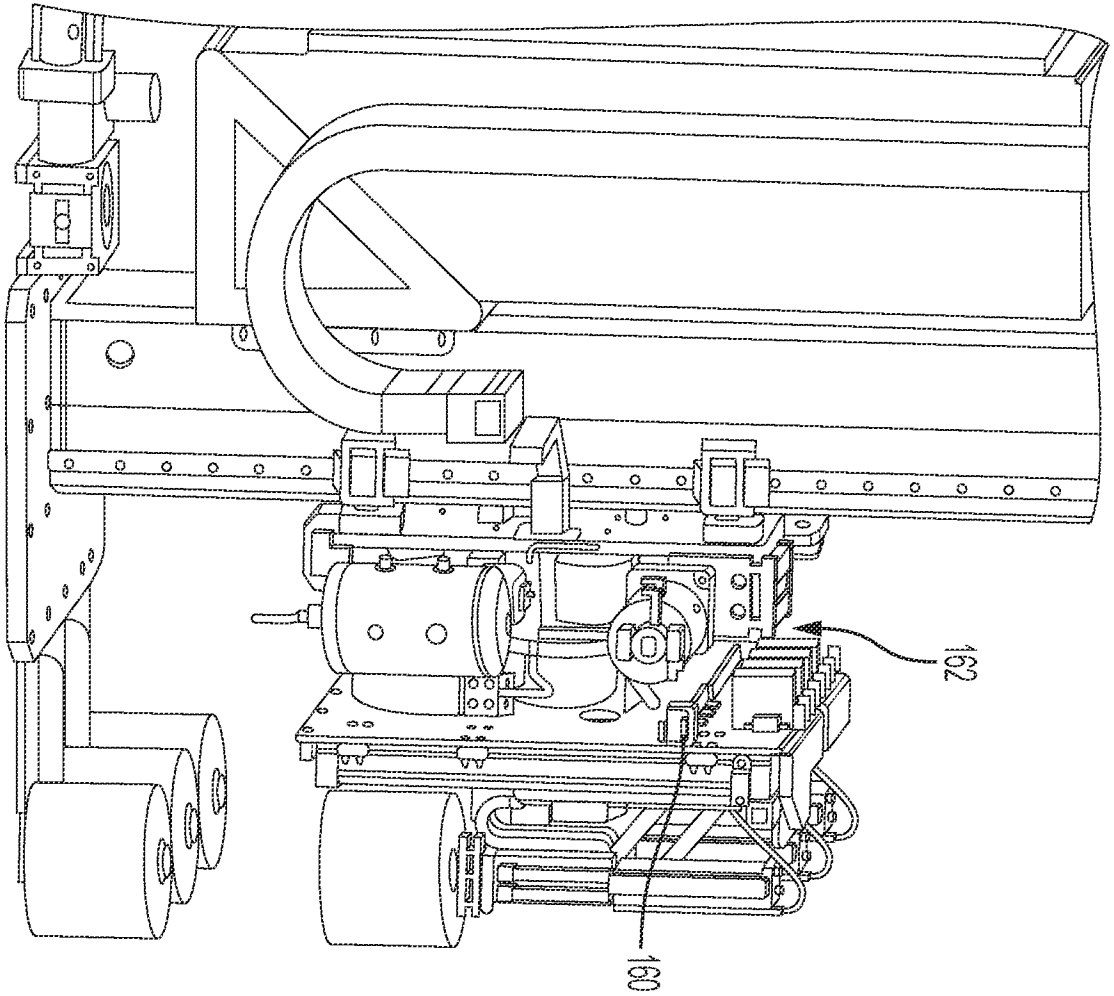
FIG. 17 is a side view of the gantry of FIG. 12.

Referring to FIG. 17, a first camera 160 can attach to the second portion 104*b* of the platform 104. The first camera 160 can be configured to detect a diameter of a yarn package 120. The first camera 160, and each of the cameras described herein, can optionally be an IFM O3D302. A computing device 1001 (FIG. 19) in communication with the camera 160 can be configured to approximate a remaining quantity of material on the yarn package 120. For example, the first camera 162 can be at a fixed position from each yarn package on the respective yarn package engagement location. The remaining quantity of yarn can be approximated based on the amount of area that the yarn package encompasses within the camera's field of view. In some embodiments, the measurement error can be within plus or minus five percent. In some embodiments, the first camera can be disposed so that it captures images of yarn packages 120 on a first side (with respect to a plane that includes the first axis 106 and the second axis 108) of the gantry, and a second camera 162 (labeled but not shown) can be disposed opposite the first camera so that it can capture images of yarn packages 120 on the opposite side of the gantry.

Figure 15:
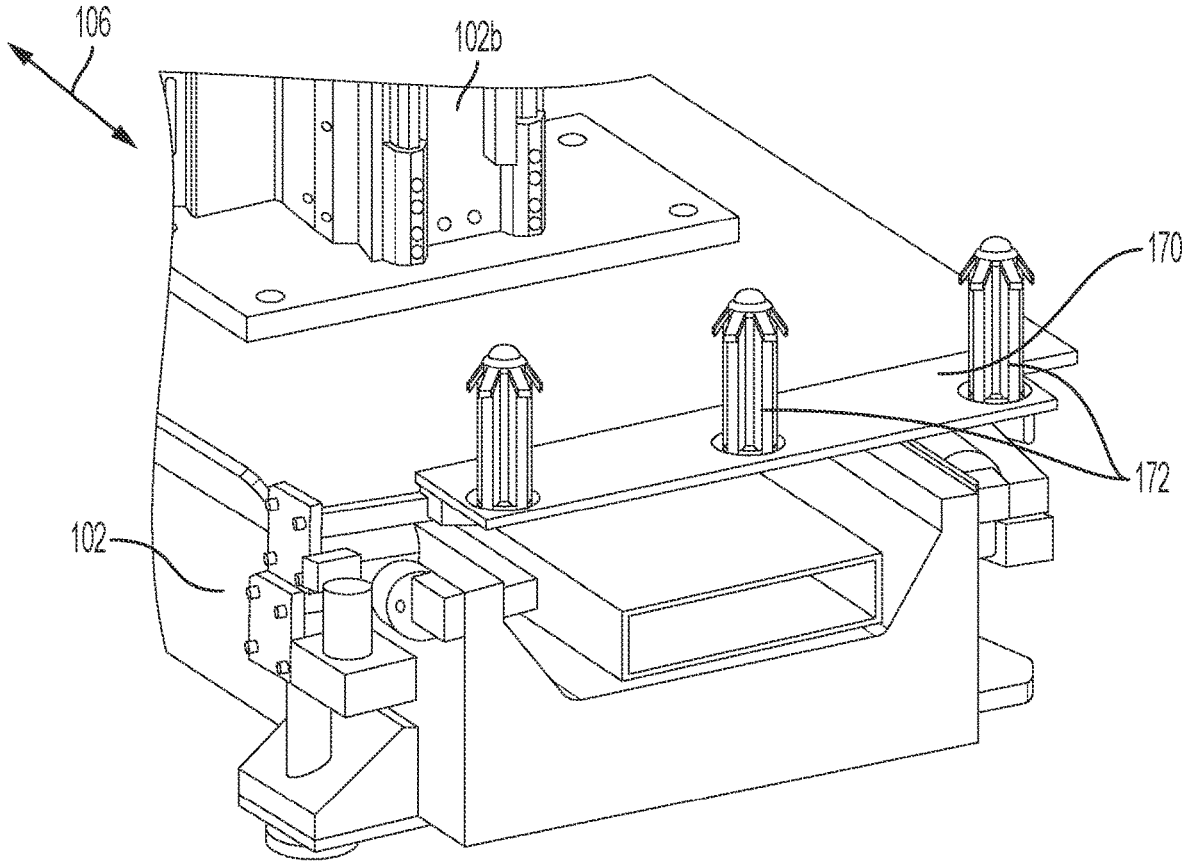
FIG. 15 is a perspective view of a staging platform of the gantry of FIG. 12.
Figure 16B:
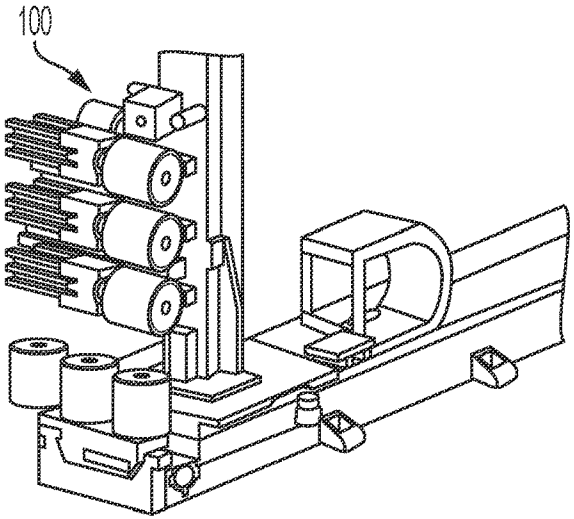
FIG. 16*b* is a perspective view of the gantry when the staging platform is loaded and end effectors of the gantry are loaded and in a retracted position.
Figure 16C:
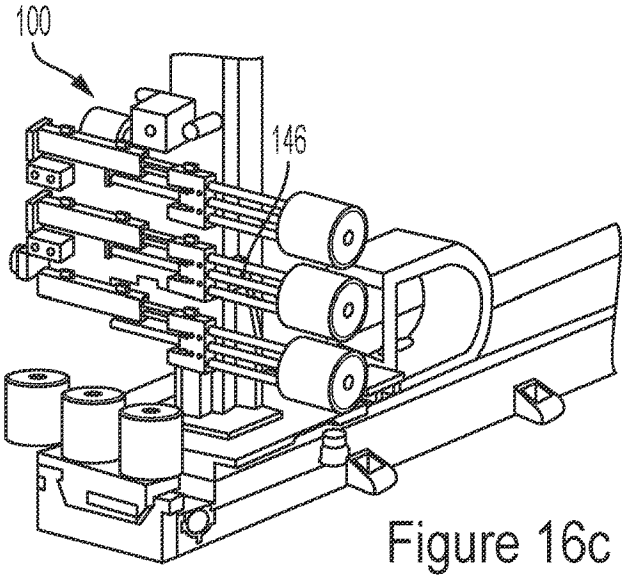
FIG. 16*c* is a perspective view of the gantry when the staging platform is loaded and end effectors of the gantry are loaded and in an extended position.
Figure 16A:
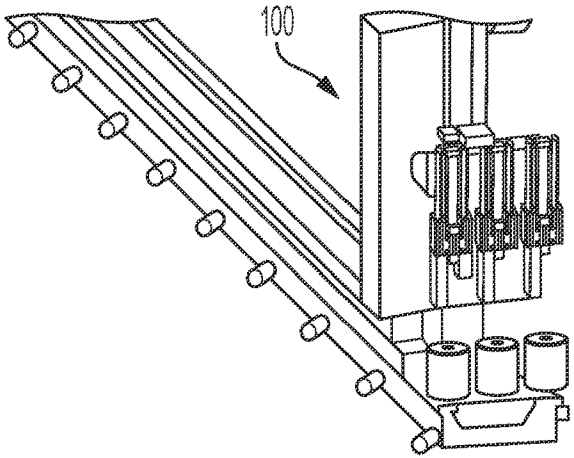
FIG. 16*a* is a perspective view of the gantry when it is loading the staging platform.

Referring to FIG. 15, a staging platform 170 can be movable along the frame 102. The staging platform 170 can attach to the mast 102*b* so that the staging platform 170 moves along the first axis 106 with the platform 104. The staging platform can comprise a plurality of bullhorns 172 that are configured to receive yarn packages 120 thereon. The bullhorns 172 can be positioned so that when the second portion 104*b* of the platform 104 is rotated so that the linear actuators axes are vertical, the bullhorns are axially aligned with the respective linear actuators' axes 114. Thus, the plurality of grippers 116 can hold a first plurality of packages 120, and the staging platform can hold a second plurality of packages 120. As further disclosed herein, the grippers 116 can position the first plurality of packages 120 on the creel module 10 (FIG. 5). The rotary actuator 112 can then rotate the second portion 104*b* of the platform 104 so that the plurality of grippers 116 are oriented to engage the second plurality of packages 120 on the staging platform 170. The plurality of grippers 116 can extend and receive respective packages 120 of the second plurality of packages, retract, and then rotate (optionally, rotating ninety degrees) in order to position the second plurality of packages on the creel module 10.

Figure 23:
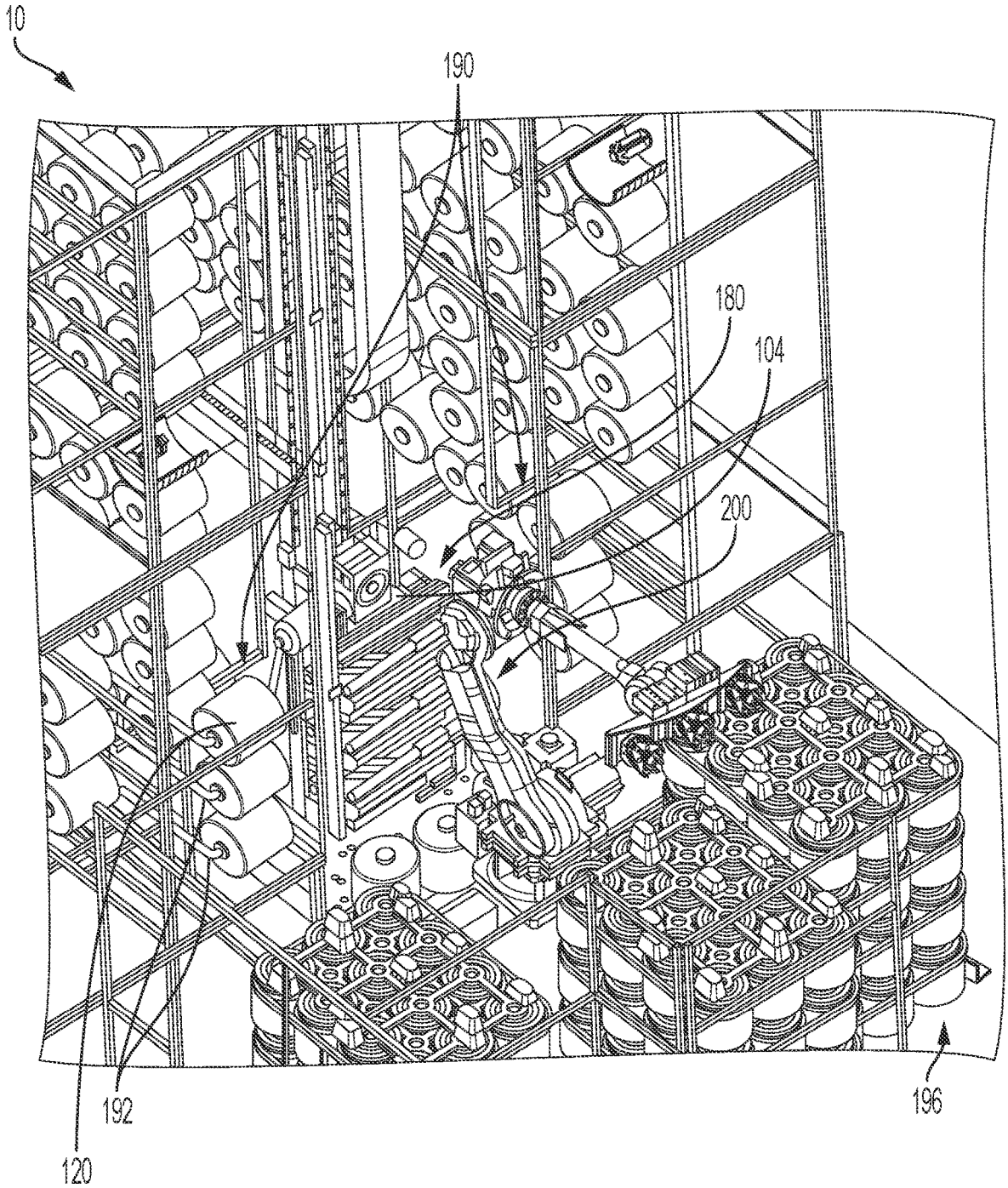
FIG. 23 a perspective view of a staging area of the modular creel system of FIG. 5.

Referring to FIG. 23, the creel module 10 can comprise a staging area 190 at a first end. A yarn case staging location 196 can receive one or more yarn cases 198 having a plurality of yarn packages 120 thereon. The yarn case staging location 196 can comprise guides 197 (FIG. 15) for locating the yarn cases 198. The staging area 190 can comprise bullhorns 192 that are similar to bullhorns 16 and are configured to receive yarn packages 120. The bullhorns can be vertically spaced along a vertical axis so that when the platform 104 is in a home position 180, the grippers 116 can be positioned to simultaneously receive the yarn packages from the staging area's bullhorns 192. In some embodiments, each creel module 10 can comprise a pair of opposing staging areas 190 that each comprise two rows of three vertically spaced bullhorns 192.

Figure 18:
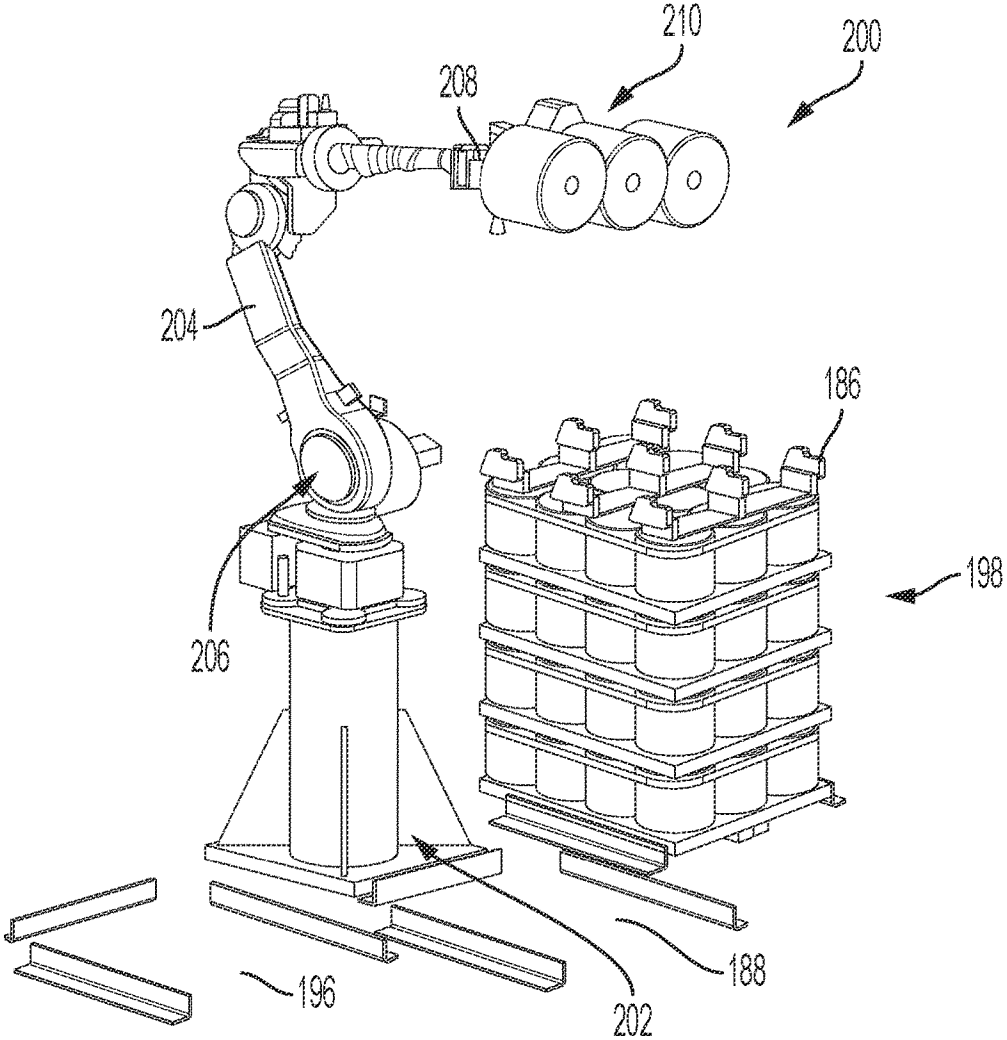
FIG. 18 is a perspective view of a service robot of the textile manufacturing system as in FIG. 5.

Referring also to FIG. 18, a service robot 200 can be disposed with respect to the staging area 190 and the yarn case staging location 196 so that the service robot can receive yarn packages from the yarn cases in the yarn case staging location 196 and load yarn packages 120 onto the bullhorns 192 of the staging area 190. The service robot 200 can comprise a base 202 that is anchored to the floor. An arm 204 can have a first end 206 that attaches to the base 202 and an operational end 208 opposite the first end 206. The arm 204 can have at least four degrees of freedom. In some embodiments, the service robot 200 can have six axes of movement. The service robot 200 can comprise a plurality of actuators that are configured to actuate movement between respective arm components at each arm joint. A gripper assembly 210 can attach to the operational end 208 of the arm 204. The gripper assembly 210 can comprise a plurality of grippers 116 (e.g., three grippers) that are spaced so that they can simultaneously load the bullhorns 192 of the staging area (i.e., having the same spacing as that of the grippers 116 on the gantry).

Figure 19:
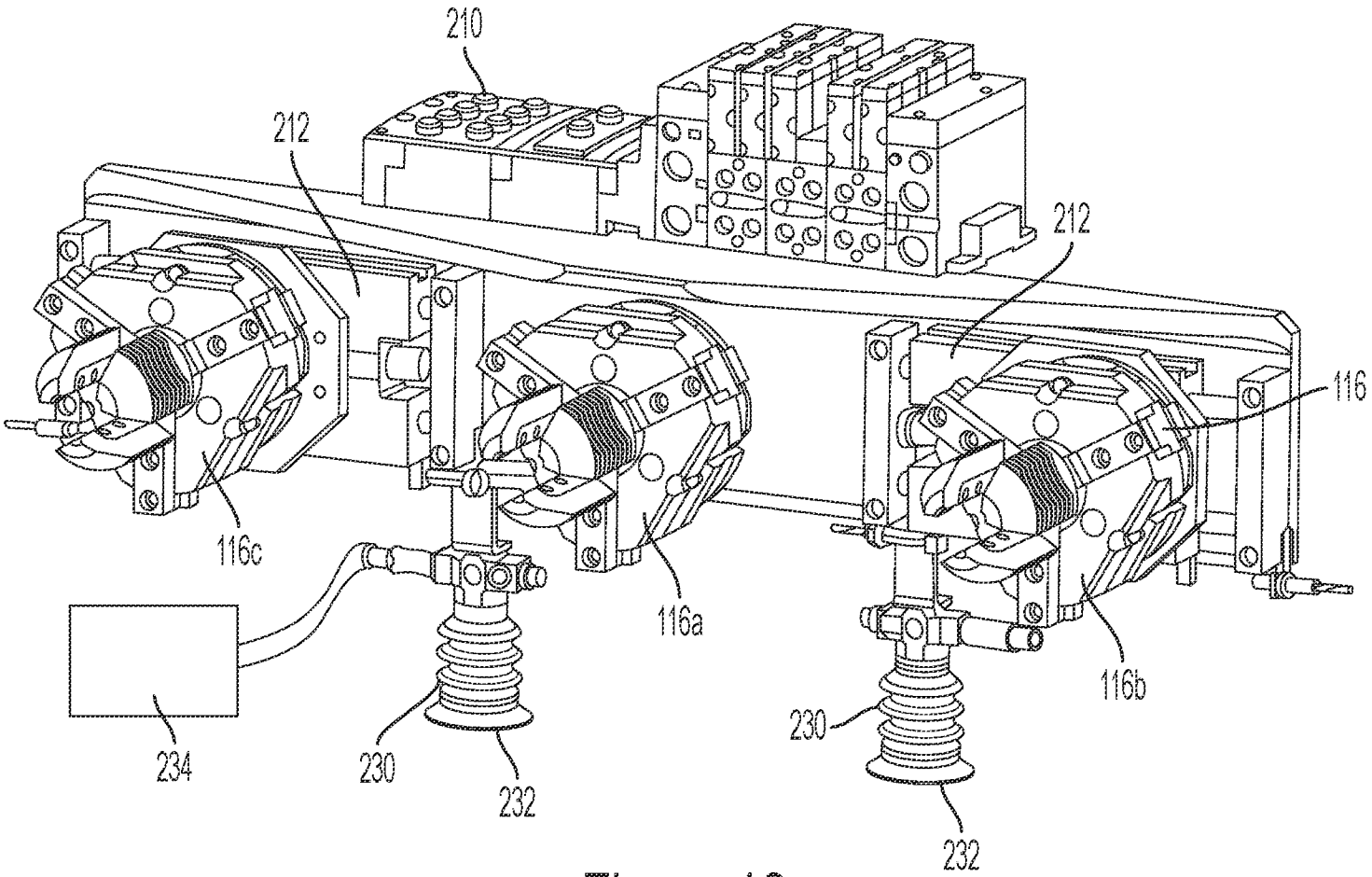
FIG. 19 is a perspective view of a gripper assembly of the service robot of FIG. 18.

Referring also to FIG. 19, according to further aspects, the gripper assembly 210 can comprise a central gripper 116*a* that is in a fixed position with respect to the gripper assembly 210. The gripper assembly 210 can further comprise a first gripper 116*b* on a first side of the central gripper 116*a* and a second gripper 116*c* on a second side, opposite the first side, of the central gripper 116*a*. The first and second grippers 116*b*, 146*c* can be coupled (e.g., attached) to respective linear actuators 212 that position the respective first or second actuator closer to and away from the central gripper 116*a* to accommodate variations in spacing of yarn packages. The linear actuators 212 can be in communication with a processor of a computing device as disclosed herein that controls their actuation. In some embodiments, the linear actuators 212 can have about two inches of travel. In one exemplary embodiment, yarn packages can be spaced 10.5 inches from center to center when on a case, bullhorns in the staging area can be spaced 12.5 inches apart from center to center. Thus, the linear actuators 212 can provide the travel to adapt for the spacing difference.

Figure 20:
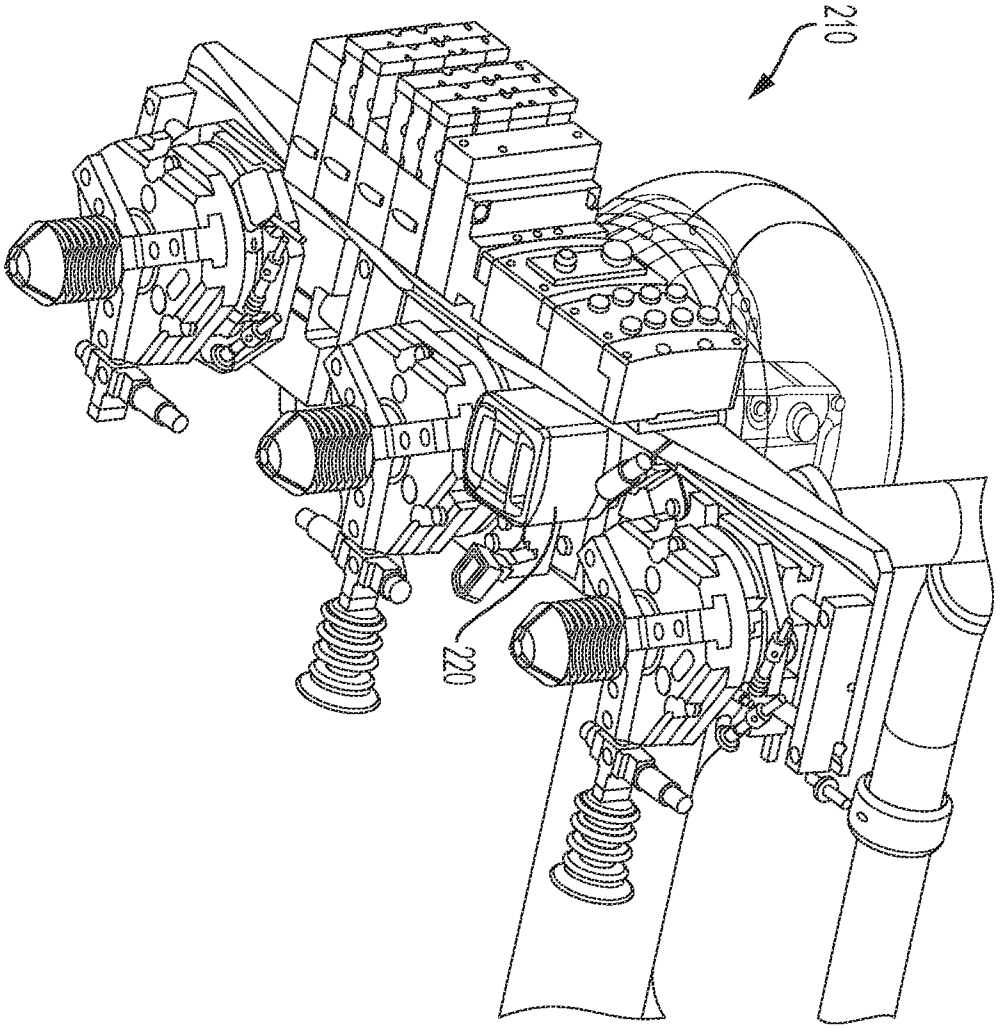
FIG. 20 is an underside perspective view of the gripper assembly of FIG. 19
Figure 24:
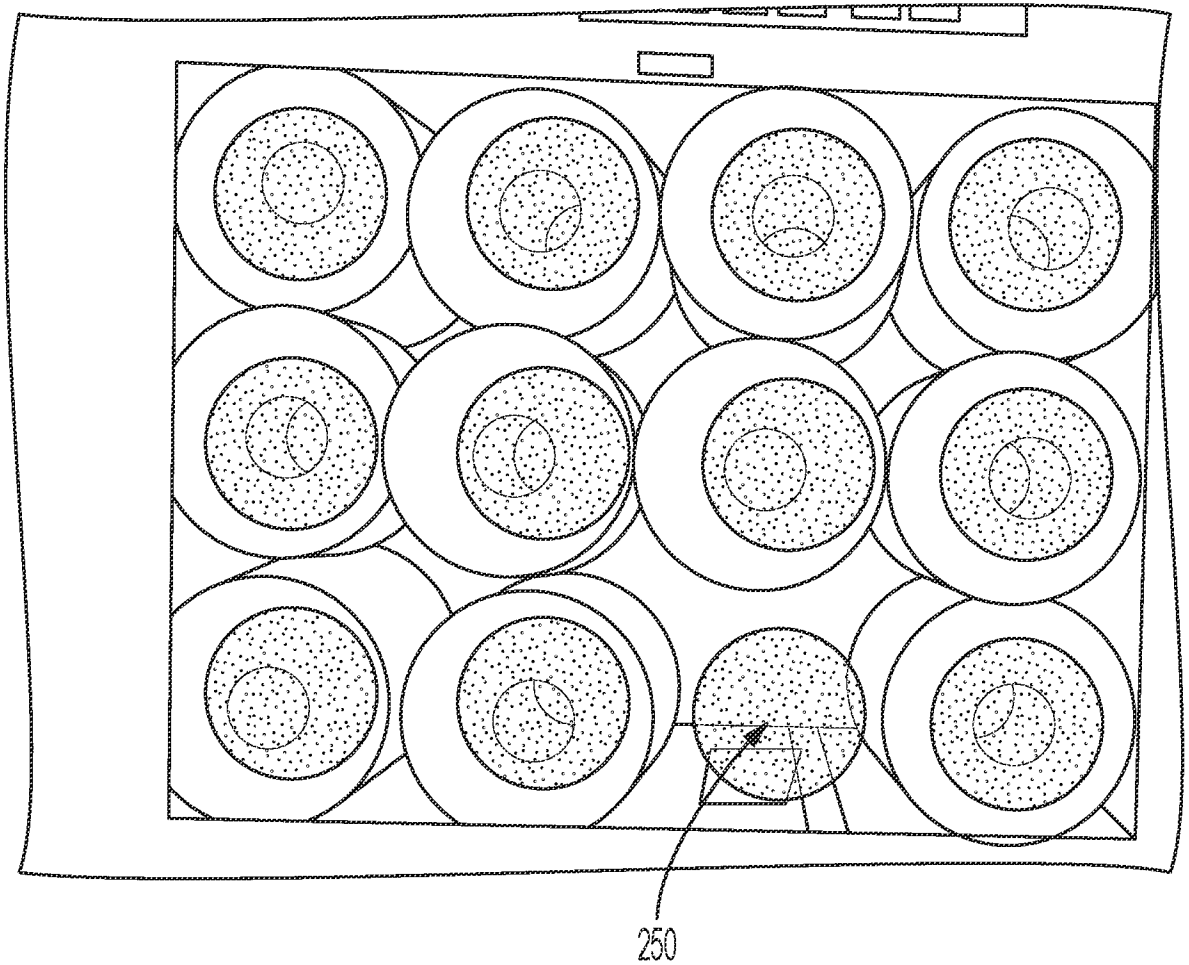
FIG. 24 is an image of a yarn case taken by a camera of the service robot of FIG. 18.
Figure 26:
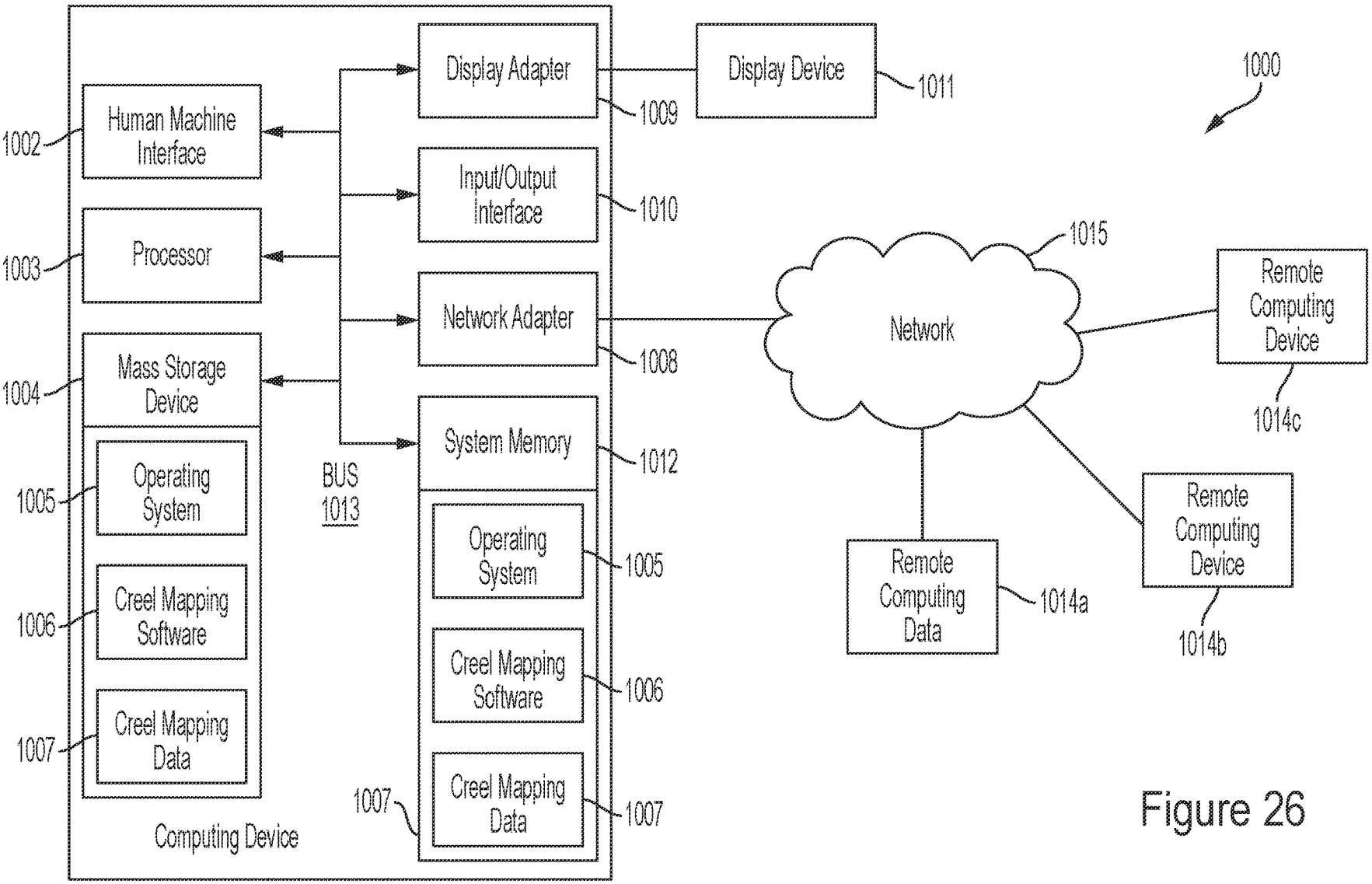
FIG. 26 is a block diagram of a computing device for use with the textile manufacturing system of FIG. 5.

Referring also to FIG. 20, the service robot 200 (FIG. 18) can further comprise a camera 220. The camera 220 can be a three-dimensional camera. The camera 220 can be in communication with a computing device 1001 (FIG. 26). The computing device 1001 can receive images of a given yarn case 198 in the yarn case staging location 196 from the camera 220 and process the images to determine a quantity of yarn packages 120 on said case. The camera can be a range camera. That is, the camera (and a coupled processor) can determine a distance between the camera and an object (e.g., a yarn package 120). The camera and coupled processor can be configured to determine presence or absence of yarn packages in a horizontal array. For example, a yarn case can comprise a plurality of stacked horizontal layers. The camera can capture the top layer for determining the presence or absence of yarn packages on the top layer. For example, referring to FIG. 24, the system can detect the missing package 250 (i.e. an empty location without a package present). The camera and coupled processor can further be configured to determine a height of yarn packages, corresponding to a number of stacked layers of yarn packages.

Figure 21:
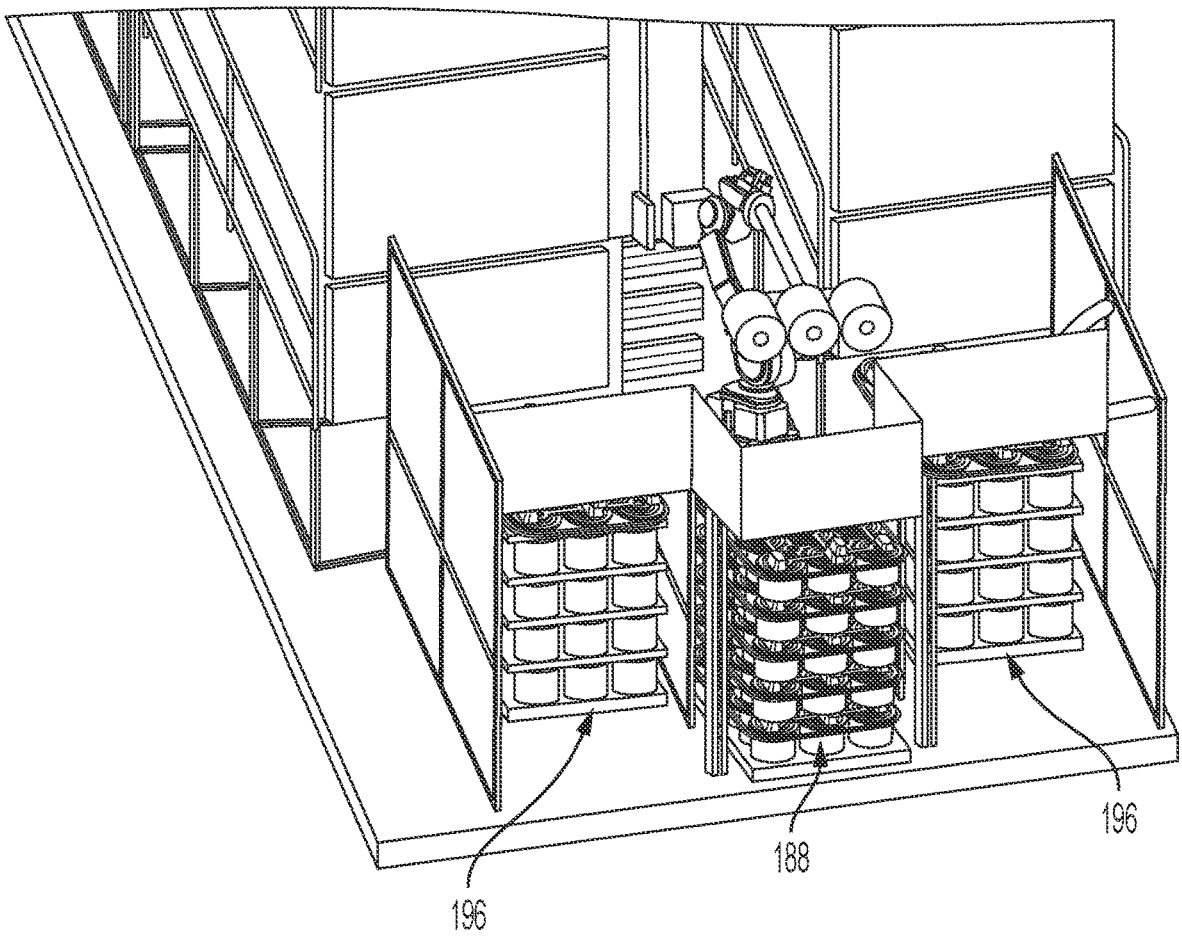
FIG. 21 is a perspective view of an end of a creel module of FIG. 5, further illustrating yarn case staging locations.
Figure 22:
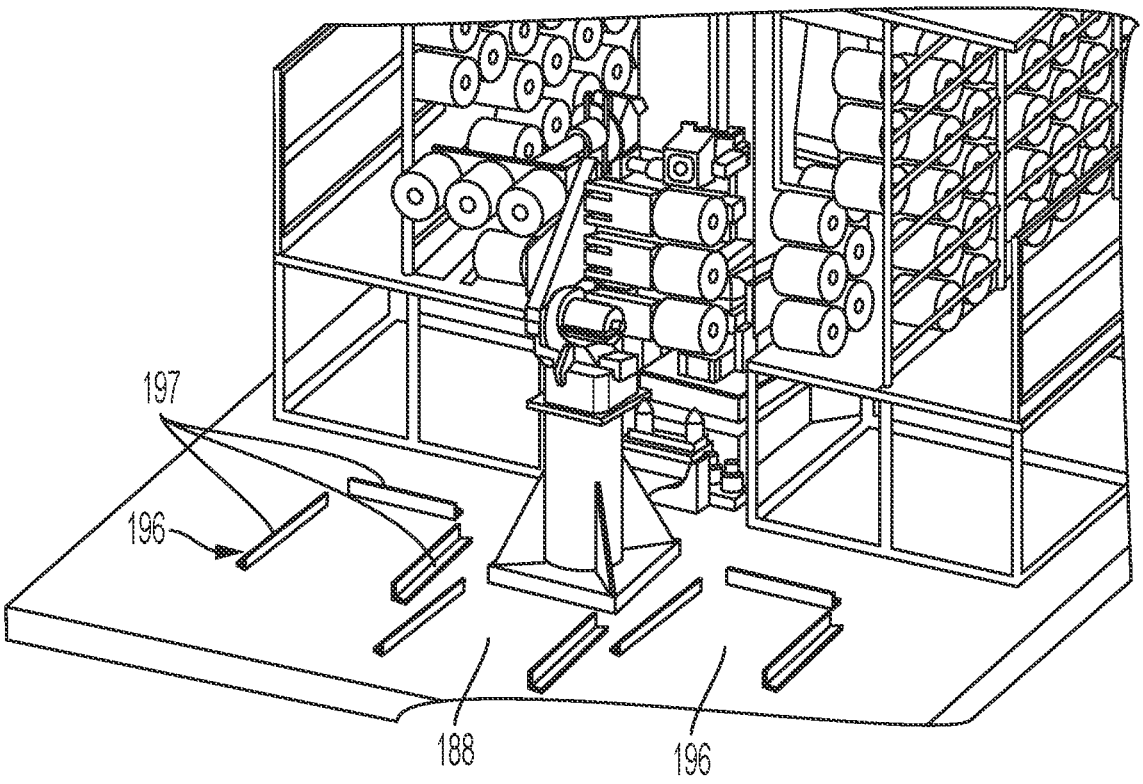
FIG. 22 is a perspective view of an end of a creel module of FIG. 5, further illustrating empty yarn case staging locations.

Referring to FIGS. 20-22, the gripper assembly 210 can comprise a dunnage removal assembly 230. The dunnage removal assembly can comprise one or more suction cups 232. Each suction cup 232 can be in fluid communication with a vacuum source 234 (e.g., a hose can extend between a vacuum pump and the suction cup 232. The suction cups 232 can be configured to grip dunnage 186 (FIG. 18), and the service robot 200 (FIG. 18) can then move the gripper assembly 210 to lift the dunnage from the case 198. The service robot 200 can then move the dunnage to a dunnage area 188 (assuming the dunnage area 188 has capacity to receive the dunnage; if the dunnage area is full, the system can notify the operator via, for example, a message or an indicator, that the dunnage area must be emptied). The service robot 200 can repeat the dunnage removal process for a plurality of layers of dunnage.

In some embodiments, the yarn case 198 can be received in a designated position (e.g., a yarn case staging location 196). The yarn packages 120 on a given yarn case 198 can be in fixed positions on the yarn case. In this way, the service robot 200 can, in knowing the position of the yarn case 198, determine the positons of each yarn package 120.

Control Programming

The textile manufacturing system 2 (FIG. 5) can be controlled by a .net application on a computing device 1001 (FIG. 26). Operators can interface with the .net application via an input/output interface 1010 (FIG. 26). In some embodiments, the interface can enable the operator to control operation of the creel system. For example, the operator can input a stock keeping unit (SKU) corresponding to a final flooring (e.g., carpet) product (referred to as a "finished product SKU"), thereby causing the computing device 1001 to load the mapping database for the finished product SKU. Further, the interface can provide the operator with information about the process, such as whether or not certain packages need to be loaded onto the creel, in which yarn case staging locations yarn cases comprising such packages need to be positioned so that the textile manufacturing system 2 can load the yarn cases, or whether certain packages need to be spliced.

Creel Mapping

Each finished flooring product can have a corresponding SKU. Each finished product SKU can have a corresponding creel map that can be programmed and uploaded into the computing system 1001.

Figure 25:
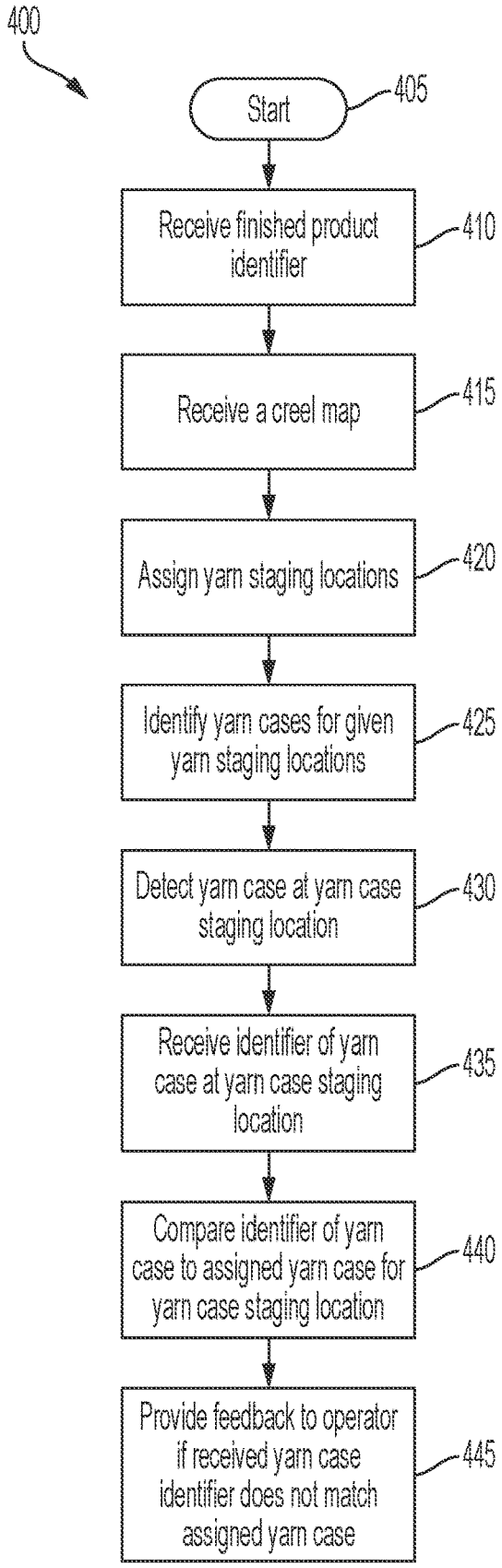
FIG. 25 illustrates a method of loading the modular creel system of FIG. 5.

Referring to FIG. 25, the computing device 1001 (FIG. 26) can perform a method 400 for assigning and monitoring staging of yarn packages. From a starting block 405, method 400 can proceed to stage 410, where the computing device 1001 receives a finished flooring product identifier. For example, an operator can input a specific finished flooring product identifier (e.g., a finished product SKU) into the computing device 1001. From stage 410, the method 400 can proceed to stage 415, where the computing device 1001 receives a creel map. For example, the computing device 1001 can receive (e.g., download from a database, as further disclosed herein), based on the input finished product identifier, a creel map comprising a plurality of yarn engagement locations and respective identifiers corresponding to yarn packages to be received at each yarn package engagement location. Thus, the map can store each yarn package engagement location and link each yarn package location to a corresponding yarn package SKU.

The map can be displayed (e.g., on the display of a computing device) as a spreadsheet comprising a first column that lists each yarn engagement location, and a second column that lists the yarn package identifier for the corresponding yarn engagement location. The respective identifiers can be, for example, SKUs of each yarn package. In further embodiments, the map can be displayed as a visualization of the creel. For example, the map can be displayed as a three-dimensional rendering of the creel having different colors, text, and/or graphics corresponding to different yarn package SKUs.

From stage 415, the method 400 can proceed to stage 420, where the computing device 1001 can assign yarn case staging locations. That is, the computing device can, using the creel map, assign yarn case staging locations for receiving respective yarn cases. Each yarn case can comprise a pallet having a plurality of yarn packages that each have the same identifier (e.g., SKU). Thus, for a map comprising a first yarn identifier and a second yarn identifier, the computing device can assign a first staging location for receiving a yarn case having yarn with the first identifier and a second staging location for receiving a yarn case having yarn with the second identifier. From stage 420, the method 400 can proceed to stage 425, where the computing device 1001 determines the yarn cases (if any) that should be positioned at each yarn case staging locations. For example, the computing device can provide, on a display, a map of each yarn case staging location and a given yarn case identifier designated to be received at each yarn case staging location. Optionally, the map can include at least one yarn case staging location that is empty.

Assigned yarn cases can then be received at each respective yarn case staging location. For example, a forklift operator or automated guided vehicle can position each yarn case at its respective yarn case staging location. From stage 425, method 400 can proceed to stage 430, where the computing device 1001 detects a yarn case at a yarn case staging location. The staging locations can comprise pallet sensors. For example, the pallet sensors can be load sensors that can detect when a sufficient weight is placed in a respective staging location. In further embodiments, a pallet sensors can each be a laser that emits a beam across the yarn case staging location and into a photodetector. When a case is placed in the respective staging location, the yarn case can block the laser from hitting the photodetector, and the computing device 1001 can receive a change in signal from the photodetector corresponding to a case being placed in the staging location.

From stage 430, method 400 can proceed to stage 435, where the computing device receives an identifier of a yarn case positioned at each yarn case staging location. According to some aspects, using a handheld scanner in communication with a computing device 1001, the operator can scan an identifier (e.g., a barcode, QR code, RFID (radio frequency identification) tag, etc.) that corresponds to a yarn case staging location. Optionally, the handheld scanning function can be performed using the computing device 1001, for example, using a camera and an optical scanning application of the computing device. The operator can then scan an identifier (e.g., a barcode, QR code, RFID tag, etc.) on the yarn case. The scannable identifier that corresponds to the yarn case staging location can optionally be located at a position at or near the yarn case staging location so that an operator at the yarn case staging location can scan both the yarn case staging location identifier and the identifier on the yarn case that is positioned on the yarn case staging location from the same standing position. From stage 435, method 400 can proceed to stage 440, where the yarn case identifier is compared to the yarn case staging location. The computing device can determine whether the yarn case is a correct match for the given staging location. From stage 440, method 400 can proceed to stage 445, where feedback is provided to the operator if the received yarn case identifier does not match the assigned yarn case identifier. If the yarn case identifier is incorrect, the system can display an error and prevent the service arm 200 from staging the yarn packages until the correct yarn case is positioned in the staging location.

In further embodiments, instead of, or in addition to, using pallet sensors at stage 430, the system can maintain knowledge of the occupied status (occupied or unoccupied) of each staging location based on scanning yarn cases onto and off of the yarn case staging location. For example, when an operator scans a staging location and then a yarn case, the computing device 1001 (FIG. 26) can store in system memory 1012 (FIG. 26) that the staging location is occupied. Similarly, as a yarn case (or empty pallet from the yarn case) is removed, the operator can scan the staging location, thereby causing the computing device to store in the system memory 1012 that the staging location is unoccupied. In still further embodiments, RFID or other automated scanning methods can be used to determine when a yarn case is in a staging location. For example, an RFID scanner can be positioned with respect to a staging location so that when a yarn case having a properly-situated RFID tag is placed in the staging location, the RFID scanner can detect the presence of the yarn case.

Once the yarn cases have been received at each yarn case staging location, the service robot 200 can provide the yarn packages to the gantry 100. The gantry can then deliver the yarn to the respective yarn package engagement locations based on the creel map.

The system memory 1012 (FIG. 26) of the computing device 1001 (FIG. 26) can include a database for monitoring occupancy of yarn packages at each yarn package engagement location. For example, when the gantry places a yarn package on a yarn package engagement location, the computing device can store in the database that the yarn package engagement location is occupied. The computing device 1001 can then check the database before providing instructions to the gantry to place another yarn package. If the computing device 1001 receives instructions to place the yarn package on an occupied yarn package location, the computing device 1001 can provide an error message or otherwise notify an operator that the yarn package location is already occupied. For example, the error message can include text on a display of a computing device, an audible alarm, and/or a status light on a control panel.

The gantry can purge yarn packages by removing the yarn packages from their respective yarn package engagement locations. In some aspects, the gantry and the service arm can further deliver the purged yarn packages to a bin, or to the yarn staging area from which the service arm receives the purged yarn packages and then places the purged yarn packages in the bin. In further aspects, the service arm can stack the purged yarn packages into a position based on the package design. For example, a pallet can comprise cylindrical or conical studs that are receivable within an inner volume defined by the package's inner surface 122 (FIG. 6). Thus, the studs can space the purged yarn packages. When a pallet has a full layer of packages, another pallet can be stacked on top of the full package layer until the case is full, at which point the full case can be removed and replaced with an empty pallet.

The computing device 1001 can allow for various levels of access. For example, the levels can comprise an operator level, a maintenance level, an engineering level, and an administrator level. Each level can be permitted or restricted access based on certain rules. For example, in some embodiments, operators can be provided access to load creel maps but not edit creel maps, whereas engineers can be permitted to edit creel maps and override certain parameters.

A program, when executed by a processor of the computing device, can enable an operator to select certain operational modes of the creel system. For example, the modes can include a strip creel mode, a load creel mode, a run mode, and a manual creeling mode. In the strip creel mode, the program can prompt the operator to verify that the ends of the yarns have been cut and prevent further operation until the operator verifies as such through the user interface as further disclosed herein. The program can then prompt the operator to verify that RTI bins (e.g., refuse/package recycle bins) are empty and in proper positions. If they are not, the program can prevent further operation until the operator verifies that the RTI bins are both empty (or have available capacity) and in proper positions and provides input indicative of properly positioned bins with available capacity. The processor can then direct the gantry to proceed to strip (i.e., remove yarn packages from) some or all of the creel. Optionally, the operator can select individual creel modules 10, portions of creel modules, or individual yarn package engagement locations for stripping.

In the load creel mode, the operator can enter or scan a finished product SKU. The program can load the creel map based on the entered finished product SKU and assign yarn case staging locations to receive select yarn cases based on the map. The operator can then scan a yarn case or otherwise input an identifier of the yarn case. The program can verify that the yarn case corresponds to an assigned yarn case from the map. If the yarn case does not match an assigned yarn case, the program can provide such feedback to the operator (through the user interface such as a text or graphical display). If the yarn case matches the assigned yarn case, the program can then allow the operator to scan a yarn case staging location. The program can then determine whether or not the yarn case staging location matches the yarn case. If the yarn case does not match, the program can provide such feedback (e.g., via an error message) and prevent the program from advancing further until the yarn case matches the assigned yarn case staging location. If the yarn case matches the assigned yarn case staging location, the program can prompt the operator to load the yarn case onto the yarn case staging location. Optionally, the program can sense the receipt of the yarn case onto the yarn case staging location. The program can repeat until each yarn case staging location has received its assigned yarn case.

The operator can then splice/tie ends of the yarn to prepare the creel for operation. Once the ends are tied, the operator can select run mode (through entry of written/typed or oral command through the user interface). The program can prompt the operator to verify that all of the yarn ends are tied. The program can prevent run mode from executing until the operator verifies that the yarn ends were tied In the manual creeling mode, the operator can select to move a package from a staging area to a module position. The operator can enter or scan a finished product SKU. For example, the operator can select the finished product SKU from a drop-down menu, type the SKU into a text input box, or scan a barcode from a book of barcodes corresponding to respective final flooring products. If a required yarn package is present either already on the creel or in a yarn case in a yarn case staging location, the system can position the yarn in the desired yarn package engagement location. If a required yarn package is not present either already on the creel or in a yarn case in a yarn package engagement location, the program can enable the operator to scan at least one yarn package. If the yarn package matches the finished product SKU, the program can advance to allow the operator to scan a location (e.g., an operator can use a barcode scanner to scan a barcode positioned at a respective yarn package receiving location). If the scanned location matches or is otherwise associated with the yarn package, the program can advance to allow the operator to load the yarn.

Additionally, in the manual creeling mode, the program can enable the operator to move a yarn package from a yarn package engagement location to a package staging location. The program can prompt the operator to verify that the yarn ends are cut. Once affirmed, the program can verify locations of RTI bin(s). For example, empty RTI bins can be placed in yarn case staging locations. To verify placement of the empty RTI bins, an operator can scan the identifier (e.g., barcode) of each yarn case staging location and an identifier (e.g., barcode) on the respective RTI bin, thereby inputting into the computing device the location of each empty RTI bin for receiving yarn packages from the creel. If the RTI bin locations are not verified, the program can prompt the operator to load the RTI bins. Otherwise, the gantry can move the yarn package from the yarn package engagement location to the package staging location.

Further, in the manual creeling mode, the program can enable the operator to move a yarn package from one yarn package engagement location to another. The processor, when executing the program, can prompt the operator to verify that the yarn ends are cut. Once affirmed, the processor, when executing the program, can cause the gantry to move the yarn package from a first yarn package engagement location to a second yarn package engagement location.

The above-disclosed system can be used according to the following process. An operator can input the SKU of a finished product. For example, the operator can select the finished product SKU from a drop-down menu, type the SKU into a text input box, or scan a barcode from a book of barcodes corresponding to respective final flooring products. In doing so, the system can load the creel map associated with the loaded SKU of the finished product. Yarn cases can then be staged at yarn case staging locations based on the loaded creel map. An operator can gain access into a fenced off pallet staging area via a hard and/or a soft (e.g., input key code) key. The service robot 200 can be moved to a home position. The home position can be a position in which the service robot is spaced from the travel of the gantry to avoid collision and spaced from the yarn case staging locations to allow placement of yarn cases thereon. The operator can scan the yarn case's SKU and then the corresponding yarn case staging location. The system can prompt the operator to load yarn package caps or verify that yarn package caps are already present on the yarn packages. The operator can verify that the yarn case is properly arranged with respect to the yarn case locators. The system can prevent the service robot from moving until the pallet sensor(s) is/are detecting yarn cases thereon. The service robot, in conjunction with the gantry, can then begin loading the respective creel module and continue until the creel is full (with each engagement location being filled in accordance with the creel map). If the yarn case becomes exhausted (as detected, for example, by the service robot's camera) the system can pause to allow the operator to scan in and load another yarn case at the yarn case staging location, as described herein. When the staging area becomes full, the service robot can go into an idle mode (e.g., motionless in the home position) until the gantry opens space in the staging area. When a layer of yarn packages is removed from the yarn case, the service robot can remove the dunnage and place the dunnage in the empty dunnage area, exposing the next layer of yarn packages for engagement with the grippers of the service robot.

The gantry can begin at a staging wait position (at a position spaced from the staging area). The gantry can wait until the service robot positions a sufficient number of yarn packages in the staging area 190. The gantry and service robot can maintain knowledge of each other's position in order to avoid collision. For example, the gantry can stay at the staging wait position until the service robot is halted in the home position. The gantry can then load the staging platform 170 and then load each of its end effectors 158. The gantry can fill the yarn package engagement locations according to the creel map.

When each of the yarn package engagement locations is full (in accordance with the creel map), the gantry can enter a check mode. In check mode, the gantry can use its cameras to measure the remaining quantity of yarn on each package. When the gantry detects a yarn package that is empty or below a threshold (e.g., a minimum operative diameter based on the amount of remaining yarn), the gantry can remove the exhausted package spool from the gantry and place it in a discard bin. The computing device can determine if a replacement yarn package of the same SKU is available at the creel module's staging area. If one is available, the service robot can place the yarn package in the staging area, and the gantry can place the yarn package in the yarn package engagement location from which the exhausted roll was removed. The system can then notify an operator to splice the yarn. If the yarn package (with the proper SKU) is not available in the staging area 190, the system can cause the service robot to place the yarn package in the yarn case staging location.

To strip the creel, the ends can first be cut (using conventional methods). At least one container must be in place and have capacity to receive yarn packages (or, preferably, be empty). If no bin is in position and with capacity to receive yarn packages, the system can prompt the operator to place or change the container. The gantry can remove yarn packages beginning from the far end (opposite the service robot) first. The gantry can fill the staging platform 170 (e.g., with three packages) and fill its end effectors. The gantry can then place the packages from its end effectors and staging platform in the staging area 190. The service robot 200 can pick up the yarn packages from the staging area and place them into the container.

Using the creel systems as disclosed herein, the creel can be loaded more quickly than conventional system and methods. For example, in some embodiments, a creel module can be loaded in less than two hours and eight minutes. Because each creel module can be loaded simultaneously, a creel comprising a plurality of modules can likewise be loaded in less than two hours and eight minutes.

Computing Device

FIG. 26 shows a system 1000 including a computing device 1001 for use with the creel system as disclosed herein.

The computing device 1001 may comprise one or more processors 1003, a system memory 1012, and a bus 1013 that couples various components of the computing device 1001 including the one or more processors 1003 to the system memory 1012. In the case of multiple processors 1003, the computing device 1001 may utilize parallel computing. In exemplary aspects, the computing device 1001 can comprise a tablet, a smart phone, a personal computer, a laptop computer, or other suitable device (e.g., handheld computing device).

The bus 1013 may comprise one or more of several possible types of bus structures, such as a memory bus, memory controller, a peripheral bus, an accelerated graphics port, and a processor or local bus using any of a variety of bus architectures.

The computing device 1001 may operate on and/or comprise a variety of computer readable media (e.g., non-transitory). Computer readable media may be any available media that is accessible by the computing device 1001 and comprises, non-transitory, volatile and/or non-volatile media, removable and non-removable media. The system memory 1012 has computer readable media in the form of volatile memory, such as random access memory (RAM), and/or non-volatile memory, such as read only memory (ROM). The system memory 1012 may store data such as creel mapping data 1007 and/or program modules such as operating system 1005 and creel mapping software 1006 that are accessible to and/or are operated on by the one or more processors 1003.

The computing device 1001 may also comprise other removable/non-removable, volatile/non-volatile computer storage media. The mass storage device 1004 may provide non-volatile storage of computer code, computer readable instructions, data structures, program modules, and other data for the computing device 1001. The mass storage device 1004 may be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Any number of program modules may be stored on the mass storage device 1004. An operating system 1005 and creel mapping software 1006 may be stored on the mass storage device 1004. One or more of the operating system 1005 and creel mapping software 1006 (or some combination thereof) may comprise program modules and the creel mapping software 1006. Creel mapping data 1007 may also be stored on the mass storage device 1004. Creel mapping data 1007 may be stored in any of one or more databases known in the art. The databases may be centralized or distributed across multiple locations within the network 1015.

A user (e.g., the creel operator) may enter commands and information into the computing device 1001 via an input device (not shown). Such input devices comprise, but are not limited to, a keyboard, pointing device (e.g., a computer mouse, remote control), a microphone, a joystick, a scanner, tactile input devices such as gloves, and other body coverings, motion sensor, and the like. These and other input devices may be connected to the one or more processors 1003 via a human machine interface 1002 that is coupled to the bus 1013, but may be connected by other interface and bus structures, such as a parallel port, game port, an IEEE 1394 Port (also known as a Firewire port), a serial port, network adapter 1008, and/or a universal serial bus (USB).

A display device 1011 may also be connected to the bus 1013 via an interface, such as a display adapter 1009. It is contemplated that the computing device 1001 may have more than one display adapter 1009 and the computing device 1001 may have more than one display device 1011. A display device 1011 may be a monitor, an LCD (Liquid Crystal Display), light emitting diode (LED) display, television, smart lens, smart glass, and/or a projector. In addition to the display device 1011, other output peripheral devices may comprise components such as speakers (not shown) and a printer (not shown) which may be connected to the computing device 1001 via Input/Output Interface 1010. Any step and/or result of the methods may be output (or caused to be output) in any form to an output device. Such output may be any form of visual representation, including, but not limited to, textual, graphical, animation, audio, tactile, and the like. The display 1011 and computing device 1001 may be part of one device, or separate devices.

The computing device 1001 may operate in a networked environment using logical connections to one or more remote computing devices 1014*a,b,c*. A remote computing device 1014*a,b,c* may be a personal computer, computing station (e.g., workstation), portable computer (e.g., laptop, mobile phone, tablet device), smart device (e.g., smartphone, smart watch, activity tracker, smart apparel, smart accessory), security and/or monitoring device, a server, a router, a network computer, a peer device, edge device or other common network node, and so on. Logical connections between the computing device 1001 and a remote computing device 1014*a,b,c* may be made via a network 1015, such as a local area network (LAN) and/or a general wide area network (WAN). Such network connections may be through a network adapter 1008. A network adapter 1008 may be implemented in both wired and wireless environments. Such networking environments are conventional and commonplace in dwellings, offices, enterprise-wide computer networks, intranets, and the Internet.

Application programs and other executable program components such as the operating system 1005 are shown herein as discrete blocks, although it is recognized that such programs and components may reside at various times in different storage components of the computing device 1001, and are executed by the one or more processors 1003 of the computing device 1001. An implementation of creel mapping software 1006 may be stored on or sent across some form of computer readable media. Any of the disclosed methods may be performed by processor-executable instructions embodied on computer readable media.

Figure 27:
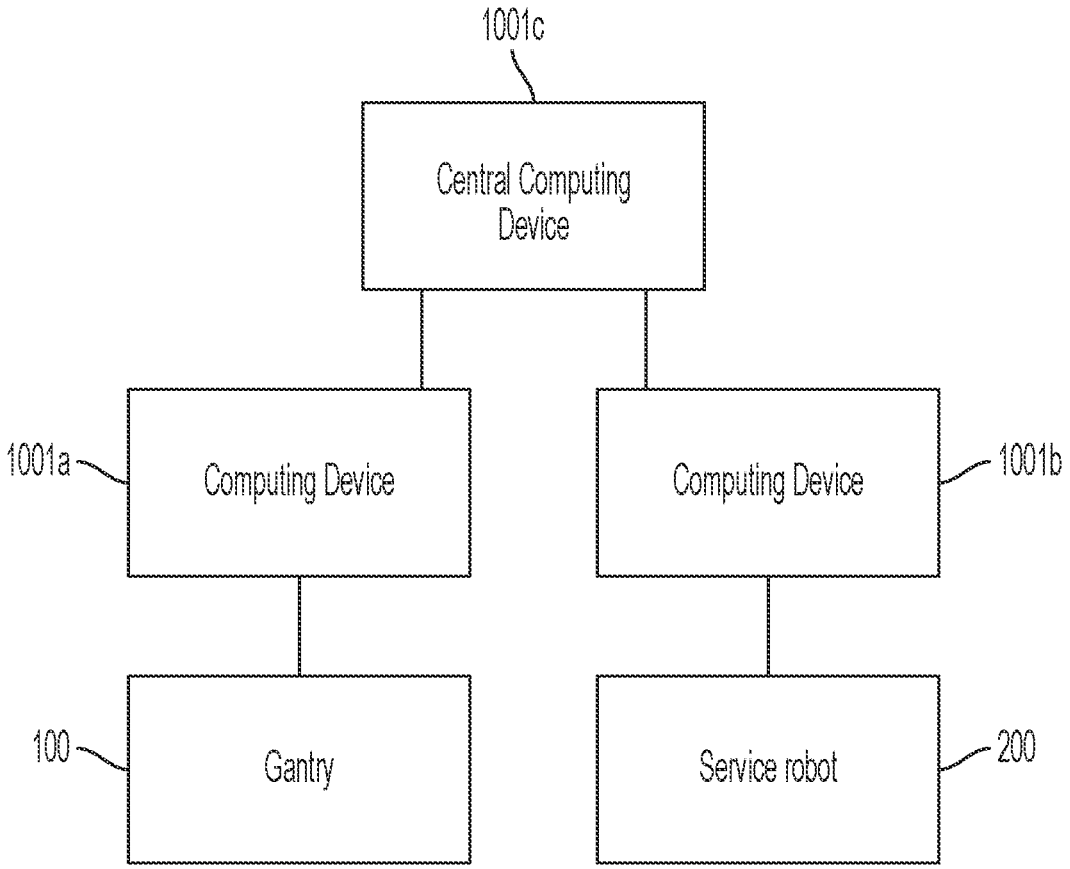
FIG. 27 is a block diagram illustrating a plurality of computing devices that cooperate to control the textile manufacturing system of FIG. 5.

In some embodiments, a single computing device 1001 can control the various processes, databases, and mechanical components of the creel. For example, in some embodiments, a computing device 1001 can control each of the service arm, the gantry, and the process mapping. In other embodiments, with reference to FIG. 27, a plurality of computing devices can cooperate to control various components of the creel. For example, a first computing devices 1001*a* can control the gantry 100, a second computing device 1001*b* can control the service arm 200, and a third computing device 1001*c* can control the process mapping. Further, the third computing device 1001*c* can interface with the first computing device 1001*a* and second computing device 1001*b* to coordinate various operations of the gantry and the service arm.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A creel loading apparatus comprising: a frame; a platform that is movable along the frame on a first axis and a second axis that is perpendicular to the first axis; a rotary actuator that is configured to rotate at least a portion of the platform about the first axis; a gripper that is movably attached to the at least a portion of the platform that is configured to rotate about the first axis, wherein the gripper is configured to releasably engage an inner surface of a yarn package; and a linear actuator that is configured to move the gripper along a linear actuator axis that is perpendicular to the first axis, wherein the linear actuator comprises a first stage and a second stage.

Aspect 2: The apparatus of aspect 1, wherein the first stage comprises a servo motor that is configured to move the gripper along the linear actuator axis, and wherein the second stage comprises a pneumatic actuator that is configured to move the gripper along the linear actuator axis.

Aspect 3: The creel loading apparatus of aspect 2, further comprising a sub-platform, wherein the servo motor is configured to move the sub-platform along a track, and wherein the pneumatic cylinder is attached to the sub-platform so that the pneumatic cylinder is in a fixed position along the linear axis with respect to the sub-platform.

Aspect 4: The creel loading apparatus of any of aspects 1-3, further comprising a second gripper and a second linear actuator, wherein the second gripper is movably attached to the platform and configured to releasably engage an inner surface of a yarn package, and wherein the second linear actuator is configured to move the second gripper along the linear axis.

Aspect 5: The creel loading apparatus of aspect 4, further comprising a third gripper and a third linear actuator, wherein the third gripper is movably attached to the platform and configured to releasably engage an inner surface of a yarn package, and wherein the third linear actuator is configured to move the third gripper along the linear axis.

Aspect 6: The creel loading apparatus of any of the preceding aspect, further comprising a camera that is attached to the platform, wherein the camera is configured to detect a diameter of a measured yarn package corresponding to a remaining quantity of material on the measured yarn package.

Aspect 7: The creel loading apparatus of aspect 6, further comprising at least one processor that is configured to: receive an image of the measured yarn package from the camera, and approximate the remaining quantity of material on the measured yarn package based on the image of the measured yarn package.

Aspect 8: The creel loading apparatus of any of the preceding aspects, wherein the frame comprises a horizontal track and a vertical member that is movable along the horizontal track, and wherein the platform is movably attached to the vertical member.

Aspect 9: The creel loading apparatus of aspect 8, further comprising a staging platform that is attached to the vertical member so that the staging platform is configured to move with the vertical member along the first axis.

Aspect 10: The creel loading apparatus of aspect 9, wherein the staging platform comprises at least one bullhorn configured to receive a yarn package thereon.

Aspect 11: The creel loading apparatus of any of the preceding aspects, wherein the gripper comprises a generally cylindrical profile having a gripper axis and at least one portion that is configured to extend and retract radially with respect to the gripper axis in order to selectively grip and release the yarn package.

Aspect 12: A system comprising: the creel loading apparatus of any one of aspects 1-11; a staging area; and a robotic arm comprising a robotic arm gripper at a distal end of the robotic arm, wherein the robotic arm and creel loading apparatus are positioned with respect to the staging area so that the robotic arm can deliver yarn packages to the staging area, and the gripper of the creel loading apparatus can receive the yarn packages from the staging area.

Aspect 13: The system of aspect 12, further comprising a creel, wherein the creel comprises the staging area.

Aspect 14: An apparatus comprising: a frame; a platform that is movable along the frame on a first axis and a second axis that is perpendicular to the first axis; a rotary actuator that is configured to rotate at least a portion of the platform about the first axis; a gripper that is movably attached to the at least a portion of the platform that is configured to rotate about the first axis and configured to releasably engage an inner surface of a yarn package; a linear actuator that is configured to move the gripper along a linear actuator axis that is perpendicular to the first axis; at least one camera that is attached to the platform, wherein the at least one camera is configured to detect a diameter of a measured yarn package corresponding to a remaining quantity of material on the measured yarn package; and at least one processor that is configured to: receive an image of the measured yarn package from the at least one camera, and approximate the remaining quantity of material on the measured yarn package based on the image of the measured yarn package.

Aspect 15: The apparatus of aspect 14, wherein the at least one camera comprises a first camera that is disposed on a first side of the platform and a second camera that is disposed on a second side of the platform opposite the first side of the platform.

Aspect 16: A method of using a creel system comprising a creel, a gantry, and a service arm, comprising: receiving a creel map comprising a plurality of yarn package engagement locations on the creel and respective identifiers corresponding to yarn packages to be received at each yarn package engagement location; assigning, based on the identifiers of the yarn packages of the creel map, yarn case staging locations for receiving respective yarn cases, wherein each yarn case has a respective identifier and comprises a plurality of yarn packages; receiving a yarn case at each respective yarn case staging location; using the service arm to provide yarn packages from the yarn cases to the gantry; and using the gantry to deliver the yarn packages to the respective yarn package engagement locations based on the creel map.

Aspect 17: The method of aspect 16, wherein receiving a yarn case at each respective yarn case staging location comprises: receiving an identifier for a yarn case to be received at each respective yarn case staging location; determining, based on the creel map, if the identifier for the yarn case corresponds to the identifier for a yarn package within the creel map; and if the identifier for the yarn case does not correspond to the identifier for a yarn package within the creel map, providing feedback to an operator.

Aspect 18: The method of aspect 17, wherein the identifier for the yarn case is a SKU.

Aspect 19: The method of any of aspects 16-18, further comprising: receiving an identifier for a yarn case at a yarn case staging location; determining if the yarn case staging location is occupied by another yarn case; and if the yarn case staging location is occupied, providing feedback to an operator of the creel system.

Aspect 20: The method of aspect 19, further comprising: receiving a yarn case on a respective yarn case staging location; and detecting the yarn case on the respective yarn case staging location.

Aspect 21: The method of aspect 19 or aspect 20, wherein detecting the yarn case on the respective yarn case staging location comprises receiving a signal from a load sensor.

Aspect 22: The method of any of aspects 19-21, wherein determining if the yarn case staging location is occupied comprises receiving a signal from a load sensor.

Aspect 23: The method of any of aspects 19-22, wherein determining if the yarn case staging location is occupied comprises receiving a value from memory corresponding to the staging location being occupied.

Aspect 24: A system comprising: a service robot having: a base; a gripper assembly having at least one gripper configured to releasably engage an inner surface of a yarn package; a service arm assembly having a proximal end secured to the base and a distal end secured to the gripper assembly; and an actuator configured to selectively move the service arm assembly to articulate the gripper assembly with respect to the base; a three-dimensional camera that is configured to determine a quantity of yarn packages on a yarn case; and at least one processor communicatively coupled to the three-dimensional camera and the actuator of the service robot, wherein the at least one processor is configured to receive an input from the three-dimensional camera indicative of the quantity of yarn packages on the yarn case, and wherein the at least one processor is further configured to selectively effect movement of the actuator.

Aspect 25: The system of aspect 24, wherein the service robot comprises at least one dunnage removal assembly that is configured to remove dunnage from within and around a yarn case.

Aspect 26: The system of aspect 25, wherein the dunnage removal assembly comprises a vacuum source and at least one suction cup in fluid communication with the vacuum source.

Aspect 27: The system of any of aspects 24-26, wherein the three-dimensional camera is a range camera.

Aspect 28: The system of any of aspects 24-27, wherein the three-dimensional camera is configured to determine a number of stacked yarn packages.

Aspect 29: The system of any of aspects 24-28, wherein the at least one gripper of the gripper assembly comprises three axially spaced grippers, wherein a central gripper is positioned between first and second outer grippers.

Aspect 30: The system of aspect 29, wherein the first and second outer grippers are operatively coupled to respective linear actuators that are configured to selectively adjust the axial spacing of the first and second outer grippers relative to the central gripper.

Aspect 31: The system of any of aspects 24-30, wherein the three-dimensional camera is coupled to the gripper assembly.

Aspect 32: The system of any of aspects 24-31, further comprising a yarn case comprising at least one yarn package, wherein the yarn case is in a fixed position, and wherein the at least one yarn package is in a fixed position with respect to the yarn case so that the processor of the system can determine a position of the yarn package with respect to the service robot.

Aspect 33: A method comprising: receiving a first yarn package at a first position on a creel; storing a value in memory indicating that the first position on the creel is occupied; upon receiving an instruction to place a second yarn package at the first position on the creel, determining, based on the value in the memory, that the first position on the creel is occupied; and providing feedback to an operator indicating that the first position on the creel is occupied.

Aspect 34: A system comprising: a creel defining a plurality of yarn package positions; a gantry configured to receive yarn packages at a loading location and place the yarn packages at select positions on the creel; a service robot configured to deliver packages to the gantry; a memory coupled with the one or more processors, the memory having thereon a plurality of instructions to implement a method comprising: receiving a creel map comprising a plurality of yarn package engagement locations on the creel and identifiers for a yarn case to be received at each respective yarn case staging location; based on the creel map, causing the service robot to deliver select yarn packages from respective yarn cases to the gantry, and based on the creel map, causing the gantry to deliver the select yarn packages to respective yarn package engagement locations.

Aspect 35: The system of aspect 34, wherein the creel comprises a plurality of sub-creel modules, and wherein the system further comprises a plurality of gantries, each gantry being configured for movement within a respective sub-creel module.

Aspect 36: A method comprising: using the system of aspect 34 to deliver the select yarn packages to respective yarn package engagement locations within a creel; and using the creel to perform a tufting operation.

Aspect 37: The method of aspect 36, wherein the creel comprises at least one sub-creel module, the method further comprising: after completion of the tufting operation, coupling at least one additional sub-creel module to said at least one sub-creel module to form an enlarged creel.

Aspect 38: The method of aspect 36, wherein the creel comprises a plurality of sub-creel modules, the method further comprising: after completion of the tufting operation, decoupling at least one sub-creel module from the creel to form a smaller creel.

What is claimed is:

1. A system comprising:

a service robot having:

a base;

a gripper assembly having at least one gripper configured to releasably engage an inner surface of a yarn package;

a service arm assembly having a proximal end secured to the base and a distal end secured to the gripper assembly; and an actuator configured to selectively move the service arm assembly to articulate the gripper assembly with respect to the base;

a three-dimensional camera that is configured to determine a quantity of yarn packages on a yarn case; and at least one processor communicatively coupled to the three-dimensional camera and the actuator of the service robot, wherein the at least one processor is configured to receive an input from the three-dimensional camera indicative of the quantity of yarn packages on the yarn case, and wherein the at least one processor is further configured to selectively effect movement of the actuator.

2. The system of claim 1, wherein the service robot comprises at least one dunnage removal assembly that is configured to remove dunnage from within and around a yarn case.

3. The system of claim 2, wherein the dunnage removal assembly comprises a vacuum source and at least one suction cup in fluid communication with the vacuum source.

4. The system of claim 1, wherein the three-dimensional camera is a range camera.

5. The system of claim 1, wherein the three-dimensional camera is configured to determine a number of stacked yarn packages.

6. The system of claim 1, wherein the at least one gripper of the gripper assembly comprises three axially spaced grippers, wherein a central gripper is positioned between first and second outer grippers.

7. The system of claim 6, wherein the first and second outer grippers are operatively coupled to respective linear actuators that are configured to selectively adjust the axial spacing of the first and second outer grippers relative to the central gripper.

8. The system of claim 1, wherein the three-dimensional camera is coupled to the gripper assembly.

9. The system of claim 1, further comprising a yarn case comprising at least one yarn package, wherein the yarn case is in a fixed position, and wherein the at least one yarn package is in a fixed position with respect to the yarn case so that the processor of the system can determine a position of the yarn package with respect to the service robot.

10. The system of claim 1, further comprising:

a creel defining a plurality of yarn package positions;

a gantry configured to receive yarn packages at a loading location and place the yarn packages at select positions on the creel, wherein the service robot is configured to deliver packages to the gantry; and a memory coupled with the one or more processors, the memory having thereon a plurality of instructions to implement a method comprising:

receiving a creel map comprising a plurality of yarn package engagement locations on the creel and identifiers for a yarn case to be received at each respective yarn case staging location, based on the creel map, causing the service robot to deliver select yarn packages from respective yarn cases to the gantry, and based on the creel map, causing the gantry to deliver the select yarn packages to respective yarn package engagement locations.

11. The system of claim 10, wherein the creel comprises a plurality of sub-creel modules, and wherein the system further comprises a plurality of gantries, each gantry being configured for movement within a respective sub-creel module.

12. The system of claim 10, wherein the gantry comprises:

a frame;

a platform that is movable along the frame on a first axis and a second axis that is perpendicular to the first axis;

a rotary actuator that is configured to rotate at least a portion of the platform about the first axis;

a gripper that is movably attached to the at least a portion of the platform that is configured to rotate about the first axis, wherein the gripper is configured to releasably engage an inner surface of a yarn package; and a linear actuator that is configured to move the gripper along a linear actuator axis that is perpendicular to the first axis, wherein the linear actuator comprises a first stage and a second stage.

13. The system of claim 12, wherein the first stage comprises a servo motor that is configured to move the gripper along the linear actuator axis, and wherein the second stage comprises a pneumatic actuator that is configured to move the gripper along the linear actuator axis.

14. The system of claim 13, wherein the linear actuator further comprises a sub-platform, wherein the servo motor is configured to move the sub-platform along a track, and wherein the pneumatic actuator is attached to the sub-platform so that the pneumatic actuator is in a fixed position along the linear axis with respect to the sub-platform.

15. The system of claim 14, further comprising a second gripper and a second linear actuator, wherein the second gripper is movably attached to the platform and configured to releasably engage an inner surface of a yarn package, and wherein the second linear actuator is configured to move the second gripper along the linear axis.

16. The system of claim 15, further comprising a third gripper and a third linear actuator, wherein the third gripper is movably attached to the platform and configured to releasably engage an inner surface of a yarn package, and wherein the third linear actuator is configured to move the third gripper along the linear axis.

17. The system of claim 12, further comprising a camera that is attached to the platform, wherein the camera is configured to detect a diameter of a measured yarn package corresponding to a remaining quantity of material on the measured yarn package.

18. The system of claim 17, wherein the one or more processors are configured to:

receive an image of the measured yarn package from the camera; and approximate the remaining quantity of material on the measured yarn package based on the image of the measured yarn package.

19. The system of claim 12, wherein the frame comprises a horizontal track and a vertical member that is movable along the horizontal track, and wherein the platform is movably attached to the vertical member.

20. The system of claim 19, further comprising a staging platform that is attached to the vertical member so that the staging platform is configured to move with the vertical member along the first axis.

* * * * *